US010357689B2

(12) United States Patent
McCoy

(10) Patent No.: US 10,357,689 B2
(45) Date of Patent: Jul. 23, 2019

(54) SELECTABLE SPEED BAG SUPPORT APPARATUS

(71) Applicant: Terri L. McCoy, Aurora, CO (US)

(72) Inventor: Terri L. McCoy, Aurora, CO (US)

( * ) Notice: Subject to any disclaimer, the term of this patent is extended or adjusted under 35 U.S.C. 154(b) by 150 days.

(21) Appl. No.: 15/418,776

(22) Filed: Jan. 29, 2017

(65) Prior Publication Data

US 2017/0216679 A1 Aug. 3, 2017

Related U.S. Application Data

(60) Provisional application No. 62/289,875, filed on Feb. 1, 2016.

(51) Int. Cl.

| | |
|---|---|
| ***A63B 22/00*** | (2006.01) |
| ***A63B 24/00*** | (2006.01) |
| ***A63B 69/20*** | (2006.01) |
| ***A63B 69/24*** | (2006.01) |

(52) U.S. Cl.

CPC ..... *A63B 24/0087* (2013.01); *A63B 69/205* (2013.01); *A63B 69/24* (2013.01); *A63B 2022/0092* (2013.01); *A63B 2209/08* (2013.01); *A63B 2225/09* (2013.01); *A63B 2225/093* (2013.01); *A63B 2244/102* (2013.01)

(58) Field of Classification Search

CPC ... A63B 24/0087; A63B 69/24; A63B 69/205; A63B 2244/102; A63B 2225/093; A63B 2225/09; A63B 2022/0092; A63B 2209/08

See application file for complete search history.

(56) References Cited

U.S. PATENT DOCUMENTS

| | | | | |
|---|---|---|---|---|
| 5,048,822 | A | 9/1991 | Murphy | |
| 5,224,912 | A | 7/1993 | Moody | |
| 5,803,877 | A * | 9/1998 | Franey | A63B 69/32 482/83 |
| 5,897,466 | A | 4/1999 | Capach | |
| 7,484,461 | B2 | 2/2009 | Britcher | |
| 8,777,819 | B1 | 7/2014 | Quintana | |

* cited by examiner

*Primary Examiner* — Sundhara M Ganesan
(74) *Attorney, Agent, or Firm* — Roger A. Jackson

(57) ABSTRACT

A selectable support apparatus for a speed bag includes a rigid planar element having first and second end portions with a longitudinal axis therebetween, the rigid planar element also includes a first and second margins with a transverse axis therebetween. The rigid planar element having a rebound surface for the speed bag and an opposing work surface with a centerline axis therebetween. The rigid planar element also includes an elongated aperture that is disposed therethrough the rigid planar element wherein the elongated aperture is positioned parallel to and along the longitudinal axis. The elongated aperture extends for a portion of the rigid planar element as between the first and second end portions. Also, the elongated aperture extends from the rebound surface to the work surface along the centerline axis. In addition, the work surface includes a mechanism for suspending and moving the speed bag therethrough and along the elongated aperture.

18 Claims, 15 Drawing Sheets

SELECTABLE SPEED BAG SUPPORT APPARATUS

RELATED PATENT APPLICATION

This application claims the benefit of U.S. provisional patent application Ser. No. 62/289,875 filed on Feb. 1, 2016 by Terri L. McCoy of Aurora, Colo., U.S.

TECHNICAL FIELD

The present invention is directed to the field of boxing, and more particularly for a selectable speed bag support apparatus to emulate a dynamically moving sparring partner for boxing training.

BACKGROUND OF INVENTION

The health benefits of exercise are well known and applicable to all ages of individuals, including cardiovascular improvement, muscle strengthening, stretching, increased blood circulation, better coordination, sharper motor abilities, flexible joint mobility, bone health, general overall wellness, and the like. One problem as an individual typically moves from being a child to being an adult, their physical activity levels decline just when maintaining good health is at its most important as an individual ages, typically their exercise levels decline that can work against maintaining good health, thus just when an individual should be exercising and being active, their exercise and activity levels tend to decrease.

Children are normally active in going places (i.e. walking or riding a bike), playing active games in their spare time, such as football, soccer, baseball, tag, hide and seek, and the like, plus being in school, children are also active in physical education classes and after school hours sports leagues. Thus as children we are normally plenty active and in the best of health due to our young age. However, as we become adults, societal norms tend to drive us into a much more sedentary lifestyle, for instance by having a car, we tend to walk very little, nor ride a bicycle much, and as an office worker we tend to sit at a desk for long periods of time, sit in meetings, sit on airplanes, and then go out for high fat and calorie content meals at restaurants, thus as a result most adults tend to gain weight by consuming more calories coupled with a lower activity lifestyle, just when our bodies should be in better shape to compensate for aging we typically get in worse shape.

Although the benefits of exercise especially for adults are acknowledged by most everyone for weight control, maintaining agility, preventing diabetes, preventing joint strain from excessive body weight, preventing higher various internal organ workloads (especially the heart) from excessive body weight, and so on, few adults are active enough to maintain even a recommended weight, typically being only about one-fourth of the adult population is not overweight, thus an overwhelming majority of adults are overweight. So the question to ask is, why don't the majority of adults exercise especially if the health benefits are widely known?

One probable answer is that available time and convenience are a problem for engaging in an exercise program, as most adults have a full time job, a family, and other interests that all together consume most of an adult's time, this is in addition to boredom and the constant obligation of regular exercise placed upon an individual's time. Wherein, even the adults who engage in exercise programs, especially after new years in January—typically lose interest in a short amount of time, wherein this "petering-out" of individual's exercise program is acerbated by the long term slow rate of actual physical shape (endurance, strength, and appearance) improvement. Thus, a potentially helpful solution is to minimize the time, boredom, and convenience obstacles to allow for an exercise program to be more possible for a working adult on a long term basis, wherein multiple exercises could be done at the same time allowing for more exercise to get done in less time, while at the same time this "multi-tasking" of exercises would help to improve agility, coordination, and control.

It is well recognized in the prior art the benefit of rhythmic and dynamic exercise for an individual especially if that exercise simultaneously exercises numerous muscles at once making the use if an individual's time more efficient and further enhancing the individual's coordination, agility, and speed. Relating in particular to boxing there are numerous devices currently in use for the exercising of boxers, these being a heavy punching bag, a speed bag, jump rope, medicine ball, various weight lifting, aerobics-calisthenics, and other individuals who would act as sparring opponents.

Focusing in particular on the "speed bag" being the shape of a pear (having a small end and opposing large end), typically made of leather and being suspended at the small end on a Gimbal type bearing (omni directional pivot) that is adjacent to a flat surface that the large end of the bag bounces or rebounds against. The boxer for training hits the speed bag with their hands in a rhythmic manner in typically a fast sequence that helps to enhance the boxer's hand speed, their hand-eye coordination, timing, shoulder endurance, and punch power. After a boxer's first hit there should be 3-5 rebounds off of the surface by the bag large end, wherein further skill advancing would go towards 3 bag/surface rebounds (from the boxer-away then toward, and then away again prior to re-punching), wherein at first training with a single hand and then advancing to using both hands and then finally alternating hands with each punch to the bag.

As even further advanced techniques the boxer can shift weight foot to foot while punching the bag, and even though the bag is typically positioned statically (i.e. the Gimbal bearing and surface are fixed in position), the boxer can also move about the bag in a circular manner while punching the bag or even alternatively riding a stationary bike while punching the bag. All of these more advanced techniques are to further enhance agility and coordination of the rhythmic bag punching with the hands while simultaneously using the legs for dodging movement and support. Note that the key to effective speed bag use is to punch the bag in a controlled manner that is more important than punching speed alone.

The speed bag can also be used to enhance punching accuracy via single punching and pining the bag, plus side punches, and elbow hits. Typically the speed bag has vertical height adjustment to accommodate different height boxers as it is desired to have the large end of the bag should about at eye level of the boxer, however, lateral or horizontal movement or adjustment of the speed bag at the Gimbal bearing attachment to the surface is not normally an option. Note that optimal speed bag performance would dictate proper inflation of the speed bag as it is inflated with a bladder similar to a foot ball, also that the Gimbal bearing moves in all directions freely, and the surface itself, in that the surface is of necessity a hard smooth surface, plus additionally the surface needs to be mounted (via a wall, ceiling, or other support structure) in a secure, rigid, and damped manner, as this is to ensure that the speed bag bounces or rebounds properly from the surface.

This requirement for the surface mounting especially for the damped requirement results in say for instance bags of sand being placed on top of the surface essentially making the surface have the damped rigidity of a cement wall resulting in the speed bag having an energetic rebound off of the surface, i.e. such that the kinetic energy of the speed bag movement has an almost perfect coefficient of restitution off of the surface, i.e. such that the surface absorbs almost no kinetic energy from the speed bag thus conserving the majority of the speed bag kinetic energy back into the bounce or rebound. Thus due to the requirements that the surface be very rigid, solid, and damped in its support structure mounting, dictates that the surface be mounted in a fixed manner close to typically a wall or ceiling of a building. The following is a sampling of the prior art in the speed bag/heavy punch bag arts and their associated support structures, note that for heavy punch bags there is no surface requirement as the heavy punch bag is merely flexibly suspended from an overhead structure not requiring a rigid, solid, or damped support structure.

Starting with U.S. Pat. No. 5,897,466 to Capach disclosed is a heavy bag and support mechanism for allowing a bag to move in a variety of ways after being struck by the boxer. The Capach device includes a support beam having an I-shaped cross-section and a swiveling rail support that is coupled to the support beam, wherein a rolling assembly is slidably coupled with the support beam. A height adjustment tube in Capach has a swiveling couple secured to the rolling assembly. Thus Capach provides a heavy bag with a wide upper portion and a narrow lower portion and an upper surface of the wide upper portion is swively coupled with a free end of the height adjustment tube. As Capach is a heavy punch bag there is no surface needed nor a rigid and damped support for the heavy punch bag that just has a movable and flexible overhead support.

Continuing in the prior art in U.S. Pat. No. 7,484,461 to Britcher disclosed is a trolley for transporting objects hanging from an I-beam normally securely grips or latches to the I-beam via a pair of brake pads that are urged upward against the bottom of the beam by a torsion spring. What distinguishes Britcher from Capach is that Britcher has a brake mechanism for limiting the heavy punch bag. The torsion spring in Britcher is released by pulling a lever downward and by applying lateral force to the trolley, preferably by applying the lateral force to the same lever, pulls the trolley along the I-beam as the wheels engaging the upper portion of the I-beam can rotate freely once the brake pads are released. Releasing the lever in Britcher after the trolley is pulled to the desired location causes the brakes to again firmly grip the I-beam. Again, as in Capach, with Britcher there is no surface needed nor a rigid and damped support for the heavy punch bag that just has a movable and flexible overhead support.

Further, in the prior art in U.S. Pat. No. 8,777,819 to Quintana disclosed is a simulated sparring partner apparatus and method for the training and exercising of a boxer, including a variable path and height track, wherein a target article such as a heavy punching bag or boxing speed bag is suspended from the track. Included in Quintana is one or more drives for moving the target article along the track, and a control apparatus for controlling the speed and direction of movement of the carriage along the track. The drive in Quintana may move the heavy punching bag at various speeds and in either direction, either on its own, or as a result of the boxer's actions, see FIG. 1. Also, the drive in Quintana may be programmable such that the carriage follows a predetermined path at predetermined speeds. Quintana is unique that although it is primary a heavy punch bag support (see FIG. 1) that only typically needs a flexible overhead support without a rebounding surface, FIG. 6A discloses a speed bag option that is suspended from the same track mechanism that the heavy punch bag uses at support bolt 420, see FIG. 5.

It is of note that none of the other cited references utilize the same support for a heavy punch bag and a speed bag, which would be for the reasons previously cited in that the heavy punch bag only needs a flexible overhead support and the speed bag has additional needs for a surface that is rigid and damped. Given the Quintana speed bag option in FIG. 6A with the attachment to support bolt 420 in FIG. 5, it is doubtful that Quintana would have a rigid and damped surface support for the speed bag which is known in the art to be desirable, in fact Quintana does not teach anything related to the unique mounting support requirements of the speed bag, as Quintana merely suggests attaching the speed bag to the heavy punch bag sliding rail support with nothing more.

Continuing in the prior art in U.S. Pat. No. 5,224,912 to Moody disclosed is a heavy punching bag support apparatus that comprises a mounting plate, a pivot shaft, an elongated rail rotatably attached to the pivot shaft, and a trolley frame slidably riding on and supported by the rail, thereby enabling a punching bag supported on the trolley frame to be moved rotationally about the central vertical axis of the support apparatus as well as able to be linearly moved through the central vertical axis of the support apparatus, see in particular FIGS. 1 and 3. Similar to Britcher, Moody has a braking means for the heavy punch bag support that has lateral movement along the track trolley and again, as in Capach and Britcher, with Moody there is no surface needed nor a rigid and damped support for the heavy punch bag that just has a movable and flexible overhead support.

Further, in the prior art in U.S. Pat. No. 5,048,822 to Murphy disclosed is a simulated sparring partner apparatus and method for the training and exercising of a boxer, including a track, a target article such as a heavy punching bag suspended from the track, a drive for moving the punching bag along the track, and control apparatus for controlling the speed and direction of movement of the carriage along the track. The drive in Murphy may move the punching bag at various speeds and in either direction, in addition the drive may be programmable such that the heavy punching bag follows a predetermined path at predetermined speeds. Alternatively, in Murphy. motion of the heavy punching bag may be manual so as to allow a coach or trainer to control the motion of the bag. Murphy, being similar to Quintana in having a power drive trolley track for moving the heavy punching bag, plus again, as in Capach, Moody, and Britcher, with Murphy there is no surface needed nor a rigid and damped support for the heavy punch bag that just has a movable and flexible overhead support.

What is needed is a selectable speed bag support apparatus, that allows a lateral movement of the speed bag at the Gimbal bearing attachment to the surface while maintaining the previously mentioned attributes of a speed bag surface such as rigidity and dampening, further the lateral movement of the speed bag adjacent to the surface would be controllably random, with the functional goal of challenging the boxer to enhance their simultaneous coordination of their hands and feet while working the speed bag while the speed bag is arbitrarily moving laterally while remaining adjacent to the surface that is rigidly mounted and damped to a wall or ceiling. Further, the means by which the speed bag Gimbal bearing would be moving laterally adjacent to the surface would not affect the surface performance ability in rebounding the speed bag.

SUMMARY OF INVENTION

Broadly, the present invention is a selectable support apparatus for a speed bag that includes a rigid planar element having a first end portion and an opposing second end portion with a longitudinal axis spanning therebetween, the rigid planar element also includes a first margin and an opposing second margin with a transverse axis spanning therebetween. Further, the rigid planar element having a rebound surface for the speed bag and an opposing work surface with a centerline axis spanning therebetween. Wherein the longitudinal axis, the transverse axis, and the centerline axis are all perpendicularly positioned to one another.

The rigid planar element also includes an elongated aperture that is disposed therethrough the rigid planar element wherein the elongated aperture is positioned parallel to and along the longitudinal axis. The elongated aperture extends for a portion of the rigid planar element as between the first and second end portions. Also, the elongated aperture extends from the rebound surface to the work surface along the centerline axis.

In addition, the selectable support apparatus for the speed bag includes a means for suspending and moving the speed bag therethrough and along the elongated aperture.

These and other objects of the present invention will become more readily appreciated and understood from a consideration of the following detailed description of the exemplary embodiments of the present invention when taken together with the accompanying drawings, in which;

REFERENCE NUMBER IN DRAWINGS

Figure 1:
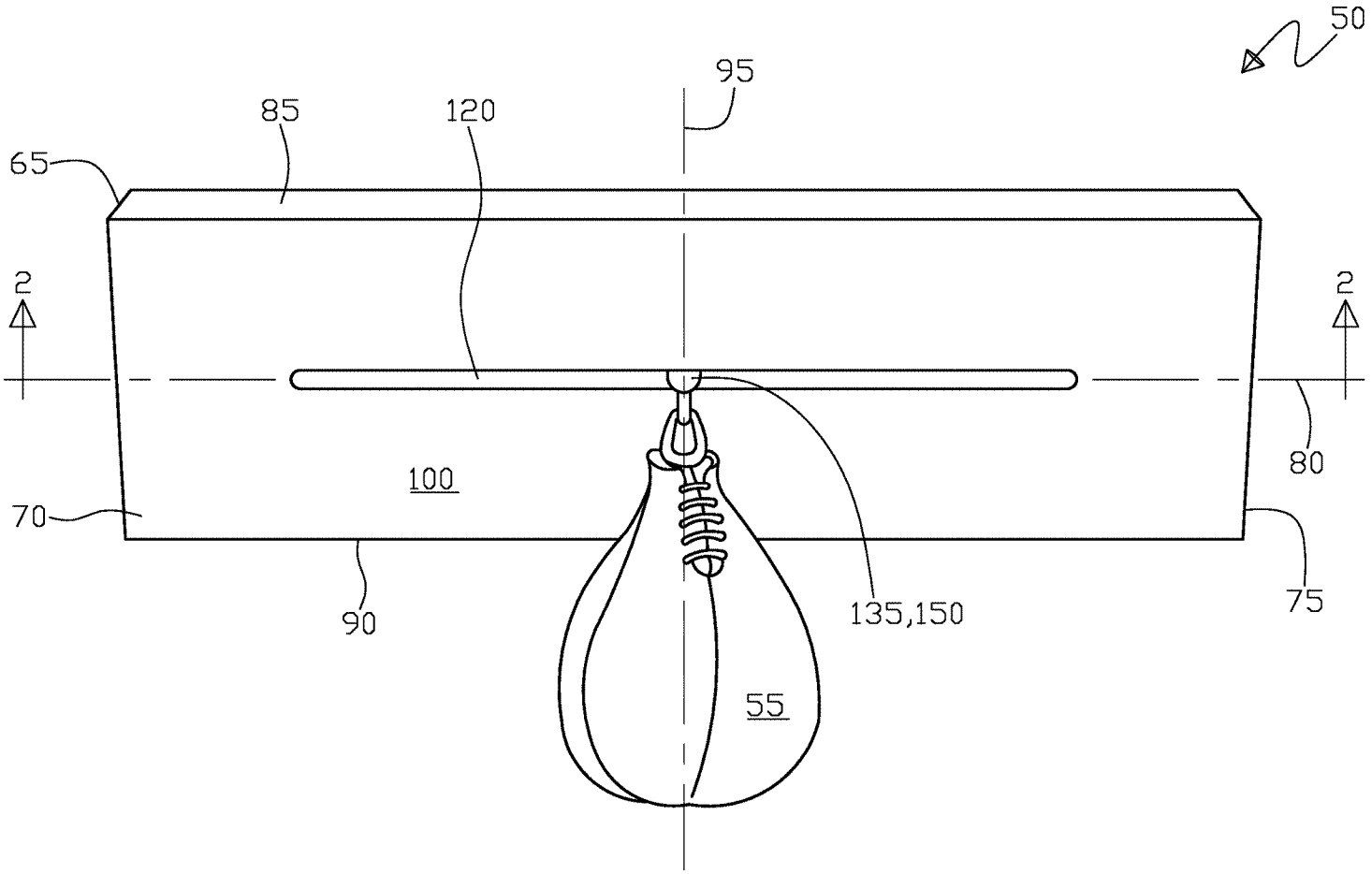
FIG. 1 shows a front perspective elevation view of the selectable speed bag support apparatus that includes the rigid planar element having the elongated aperture, with first and second end portions along with first and second margins, a longitudinal axis, and a transverse axis with the speed bag itself shown.

50 Selectable speed bag support apparatus
55 Speed bag
56 Movement of the speed bag 55
60 Building structure
65 Rigid planar element
70 First end portion of the rigid planar element 65
75 Second end portion of the rigid planar element 65
80 Longitudinal axis of the rigid planar element 65
85 First margin of the rigid planar element 65
90 Second margin of the rigid planar element 65
95 Transverse axis of the rigid planar element 65
100 Rebound surface of the rigid planar element 65
105 Work surface of the rigid planar element 65
110 Centerline axis of the rigid planar element 65
115 Perpendicular positioning of the longitudinal 80, transverse 95, and centerline 110 axes to one another
120 Elongated aperture
121 Channel of the elongated aperture 120, 360
125 Suspending the speed bag 55 therethrough the elongated aperture 120, 360, or via the magnetic couple 375
130 Moving the speed bag 55 therethrough the elongated aperture 120, 360, or the magnetic couple 375
135 Means for suspending 125 and moving 130 the speed bag 55 therethrough and along the elongated aperture 120, 360
136 Means for suspending 375 and moving 130 the speed bag 55 therethrough the rigid planar element 65 via the magnetic couple 375
140 Carriage
141 Extension of the carriage 140
145 Slidable engagement of the carriage 140 to the elongated aperture 120, 360
150 Primary end portion of the carriage 140
155 Secondary end portion of the carriage 140
160 Long axis of the carriage 140
165 Parallel position of the long 160 and centerline 110 axes
170 Adaption of the primary end portion 150 to dynamically attach to the speed bag 55
175 Drive motor
176 Bi-directional rotation of the motor 175 or rotational speed of the motor 175
180 Tensioner pulley
181 Bi-directional rotation of the tensioner pulley 180 or rotational speed of the pulley 180
182 Spring for urging of the tensioner pulley 180
185 Drive belt
190 Attachment of the drive belt 185 to the secondary end portion 155
195 Moving of the carriage 140 via the drive motor 175 within the elongated aperture 120, 360, or via the magnetic couple 375
200 Parallel movement 195 of the carriage 140 to the longitudinal axis 80
205 Mounting of the drive motor 175 and the tensioner pulley 180 to the work surface 105
210 Boxer
215 Hand motion of the boxer 210
220 Body motion of the boxer 210
300 Rebound disc for the speed bag 55
305 Omnidirectional movement of the rebound disc 300
310 Primary magnetic mover
315 Secondary magnetic follower
320 Rotational axis of the drive motor 175
325 Rotational axis of the tensioner pulley 180
330 Control circuitry to selectively vary a rotational speed 176 of the motor 175
335 Control circuitry to selectively facilitate a varying sequence a rotational speed 176 of the motor 175
340 Disc 300 affixed to the primary end portion 150 of the carriage 140
345 Radial plane of the disc 300
350 Parallel position of the radial plane 345 to the longitudinal axis 80 and the transverse axis 95
355 Slidable contact of the disc 300 against the rebound surface 100
360 Elongated aperture forming an endless loop
365 Magnetic assembly
370 Slidable contact of primary magnetic mover 310 and the work surface 105
375 Magnetic couple from the primary magnet mover 310 to the secondary magnetic follower 310
380 Slidable contact of secondary magnetic follower 310 and the rebound surface 100
385 Adaption of the secondary magnetic follower 315 to dynamically attach to the speed bag 55

390 Attachment of the drive belt 185 to the primary magnetic mover 310

395 Disc 300 affixed to the secondary magnetic follower 315

400 Rebound surface of the disc 300

DETAILED DESCRIPTION

With initial reference to FIG. 1 shown is the front perspective elevation view of the selectable speed bag support apparatus 50 that includes the rigid planar element 65 having the elongated aperture 120, with the first 70 and second 75 end portions along with the first 85 and second 90 margins, the longitudinal axis 80, and the transverse axis 95 with the speed bag 55 itself shown. Continuing, FIG. 2 shows cross section cut 2-2 from FIG. 1 that shows in particular the rigid planar element 65 and the longitudinal axis 80 plus the elongated aperture 120 with the slidably engaged 145 carriage 140 extensions 141 disposed within the channels 121 of the elongated aperture 120, further shown are the primary 150 and secondary 155 end portions of the carriage 140, wherein the primary end portion 150 is adapted 170 to dynamically attach to the speed bag 55.

Figure 2:
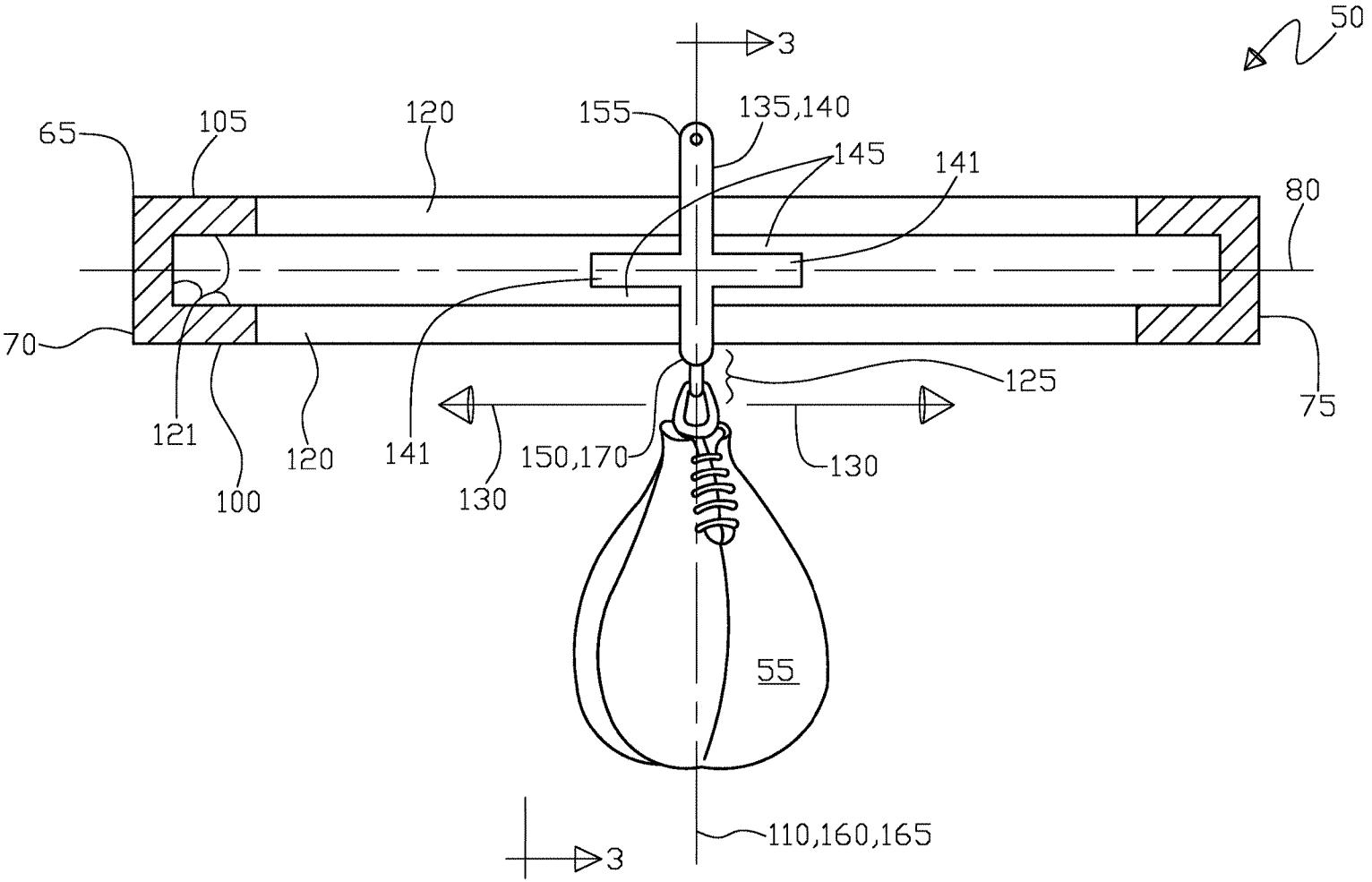
FIG. 2 shows cross section cut 2-2 from FIG. 1 that shows in particular the rigid planar element and longitudinal axis plus the elongated aperture with the slidably engaged carriage extensions disposed within the channels of the elongated aperture, further shown is the primary and secondary end portions of the carriage, wherein the primary end portion is adapted to dynamically attach to the speed bag.
Figure 3:
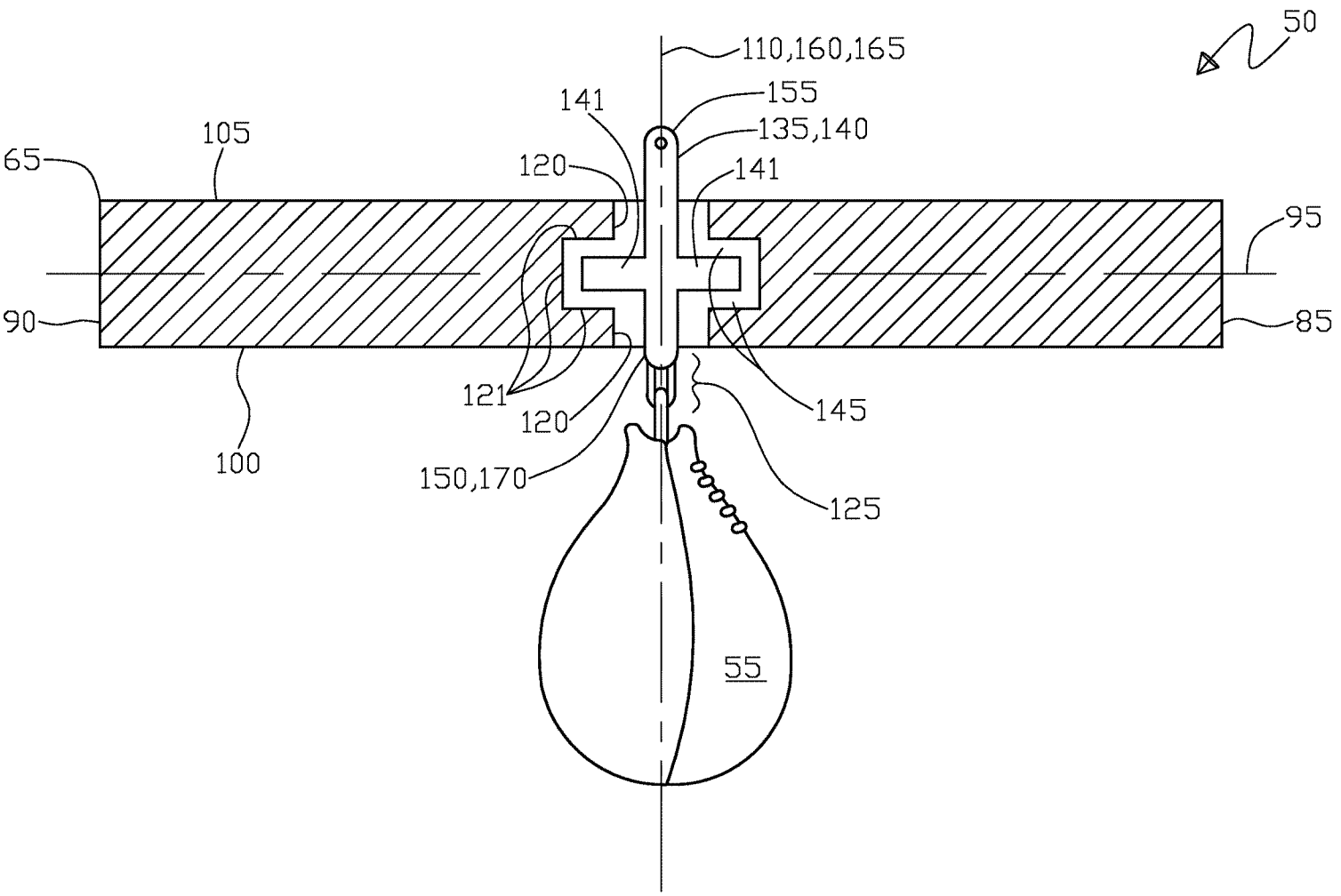
FIG. 3 shows cross section cut 3-3 from FIG. 2 that shows in particular the rigid planar element and transverse axis plus the elongated aperture with the slidably engaged carriage extensions disposed within the channels of the elongated aperture, further shown is the primary and secondary end portions of the carriage, wherein the primary end portion is adapted to dynamically attach to the speed bag.

Next, FIG. 3 shows cross section cut 3-3 from FIG. 2 that shows in particular the rigid planar element 65 and transverse axis 95 plus the elongated aperture 120 with the slidably engaged 145 carriage 140 extensions 141 disposed within the channels 121 of the elongated aperture 120, further shown is the primary 150 and secondary 155 end portions of the carriage 140, wherein the primary end portion 150 is adapted 170 to dynamically attach to the speed bag 55. Further, FIG. 4 shows a top view of the speed bag support apparatus 50 that includes the rigid planar element 65 having the elongated aperture 120 with the carriage 140 shown, with first 70 and second 75 end portions along with first 85 and second 90 margins, the longitudinal axis 80, and the transverse axis 95.

Figure 5:
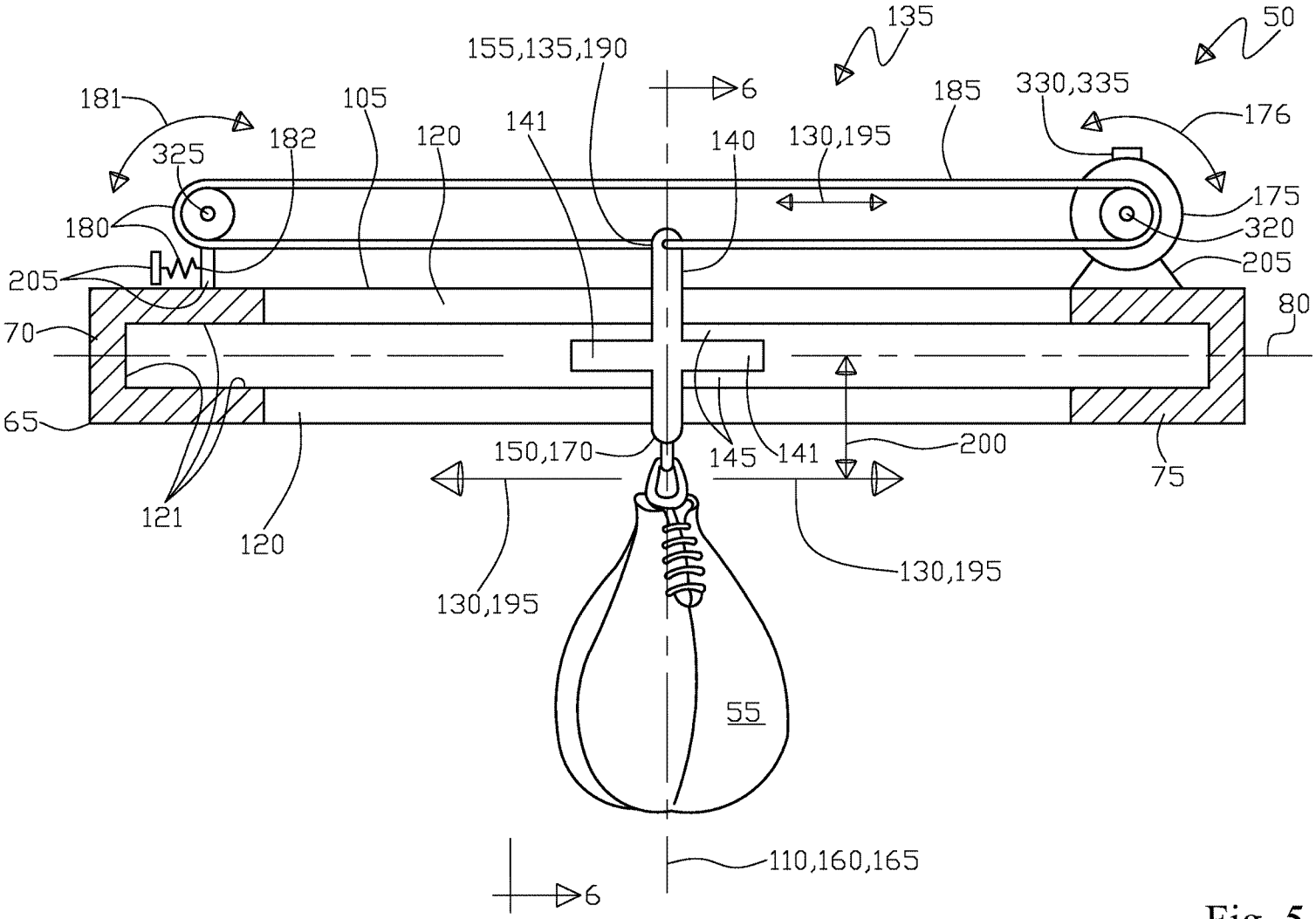
FIG. 5 shows FIG. 2 with the addition of a means for suspending and moving the speed bag therethrough and along the elongated aperture wherein the means includes a drive motor, a tensioner pulley, a drive belt, an attachment of a drive belt to the secondary end portion of the carriage with the parallel movement of the carriage via the drive motor within the elongated aperture, all with the means mounted on the work surface.
Figure 6:
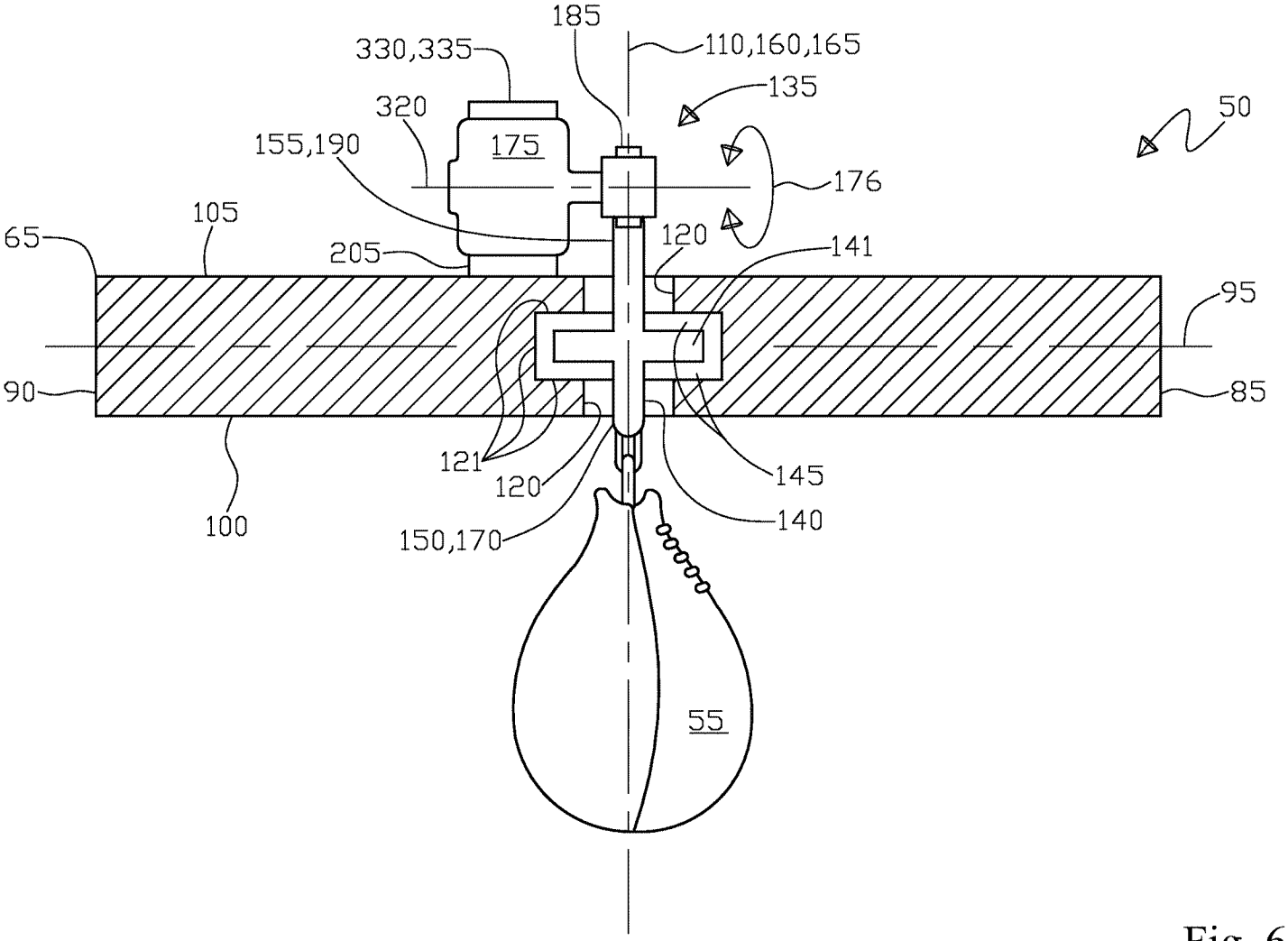
FIG. 6 shows FIG. 3 with the addition of the means for suspending and moving the speed bag therethrough and along the elongated aperture wherein the means shown includes the drive motor, the drive belt, the attachment of a drive belt to the secondary end portion of the carriage, all with the means mounted on the work surface.

Continuing, FIG. 5 shows FIG. 2 with the addition of a means 135 for suspending 125 and moving 130 the speed bag 55 therethrough and along the elongated aperture 120. Also shown in FIG. 5 is wherein the means 135 includes a drive motor 175, a tensioner pulley 180, a drive belt 185, an attachment 190 of the drive belt 185 to the secondary end portion 155 of the carriage 140 with the parallel 200 movement 195 of the carriage 140 via the drive motor 175 within the elongated aperture 120, all with the means 135 mounted 205 on the work surface 105. Next, FIG. 6 shows FIG. 3 with the addition of the means 135 for suspending 125 and moving 130 the speed bag 55 therethrough and along the elongated aperture 120 wherein the means 135 shown includes the drive motor 175, the drive belt 185, the attachment 190 of the drive belt 185 to the secondary end portion 155 of the carriage 140, all with the means 135 mounted on the work surface 105.

Figure 4:
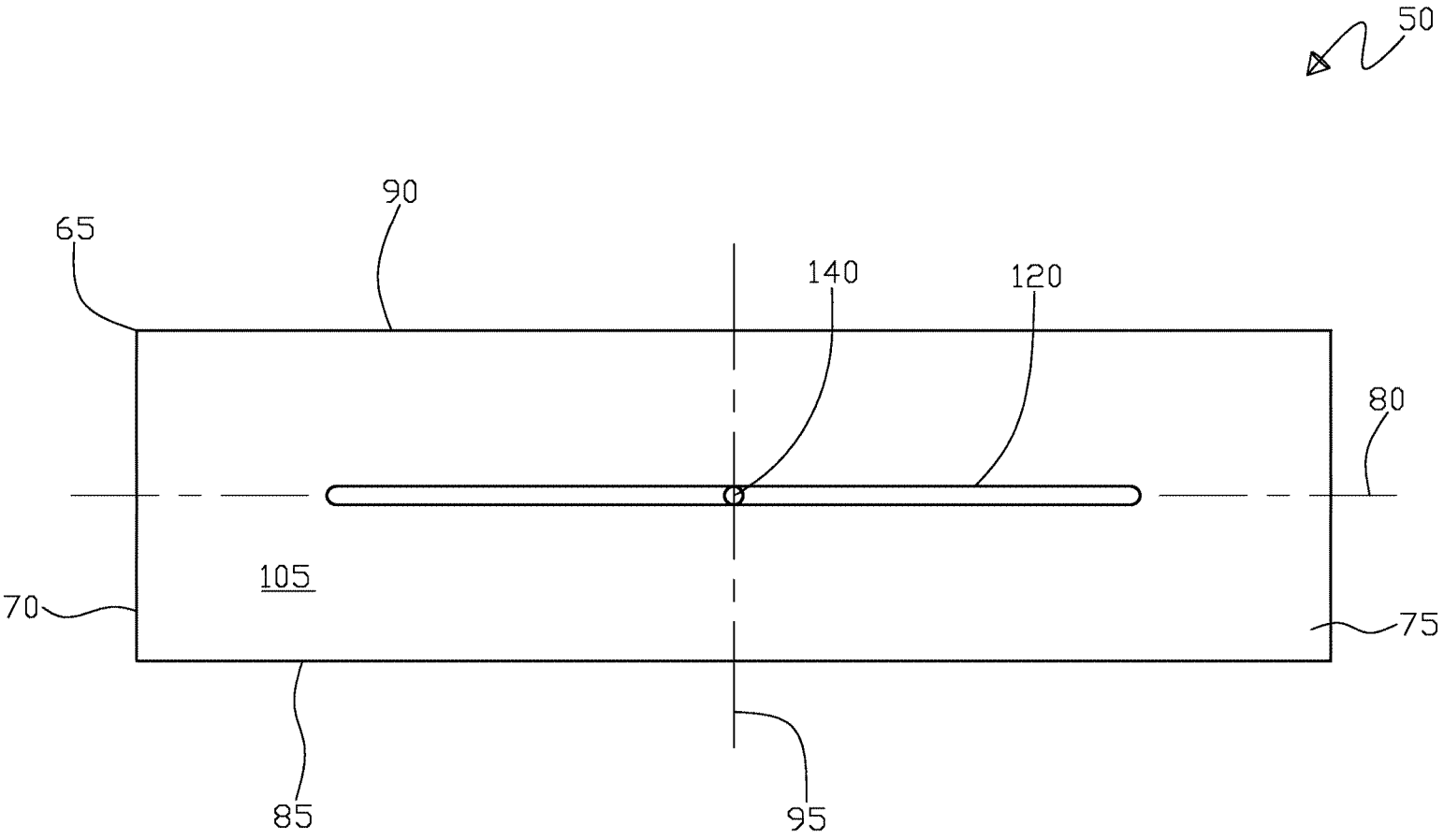
FIG. 4 shows a top view of the speed bag support apparatus that includes the rigid planar element having the elongated aperture with the carriage shown, with first and second end portions along with first and second margins, the longitudinal axis, and the transverse axis.
Figure 7:
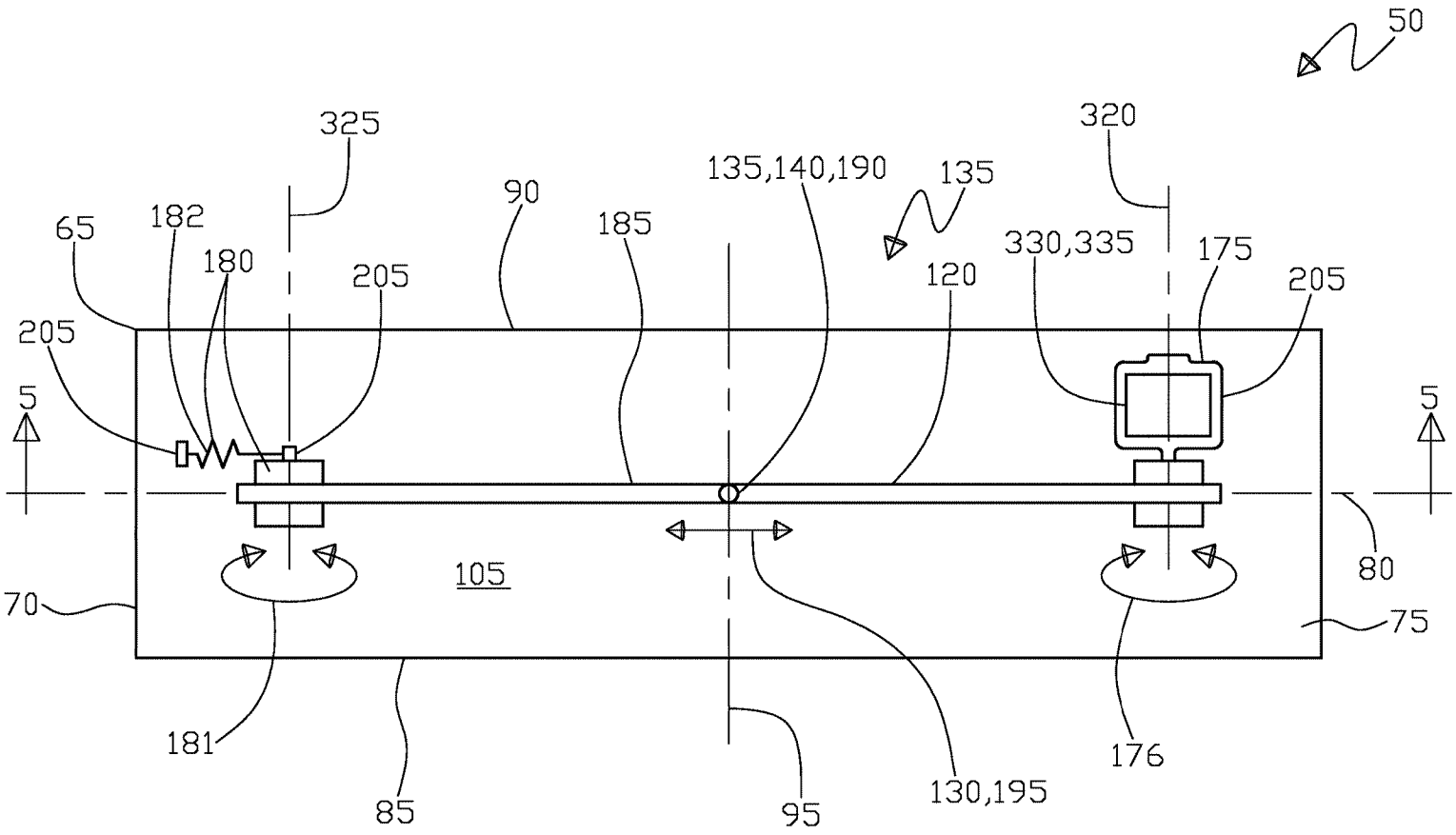
FIG. 7 shows a top view of the selectable speed bag support apparatus as shown in FIG. 4 with the addition of the means for suspending and moving the speed bag therethrough and along the elongated aperture, wherein the means includes the drive motor, the tensioner pulley, the drive belt, the attachment of the drive belt to the secondary end portion of the carriage with the parallel movement of the carriage via the drive motor within the elongated aperture, all with the means mounted on the work surface.

Further, FIG. 7 shows a top view of the speed bag support apparatus 50 as shown in FIG. 4 with the addition of the means 135 for suspending 125 and moving 130 the speed bag 55 therethrough and along the elongated aperture 120 wherein the means 135 includes the drive motor 175, the tensioner pulley 180, the drive belt 185, the attachment 190 of the drive belt 185 to the secondary end portion 155 of the carriage 140 with the parallel 200 movement 195 of the carriage 140 via the drive motor 175 within the elongated aperture 120, all with the means 135 mounted on the work surface 105.

Figure 8:
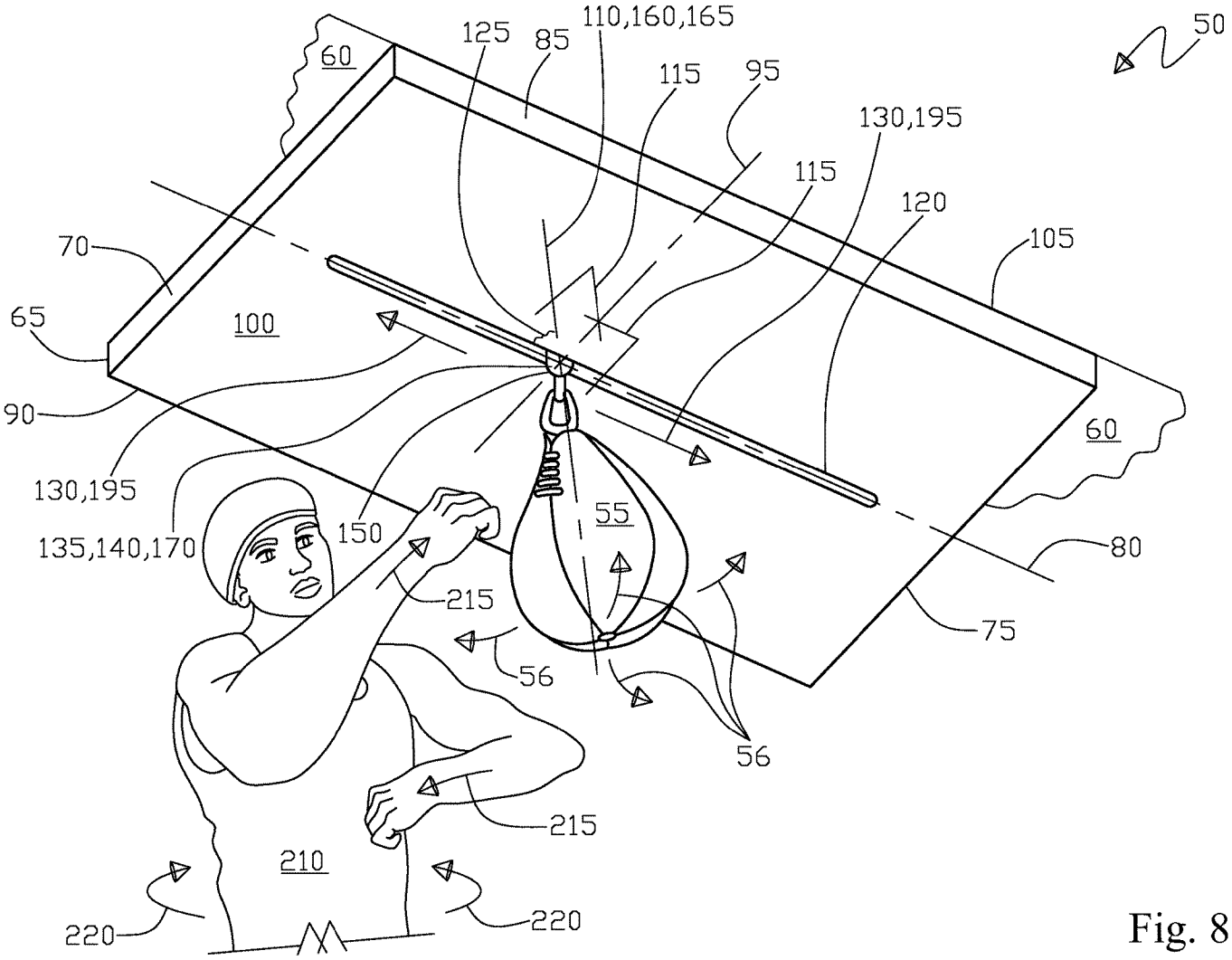
FIG. 8 shows a use drawing of the selectable speed bag support apparatus wherein the rigid planar element is affixed to the building structure, with the boxer hitting the speed bag with their hand motion causing the speed bag movement wherein simultaneously the boxer engages in body motion to accommodate the arbitrary speed bag movement to be able to further increase the boxer's multi-tasking agility in coordinated hitting of the speed bag while moving on their feet for the body motion wherein the rebound surface remains intact for the speed bag to rebound appropriately.

Continuing, FIG. 8 shows a use drawing of the selectable speed bag support apparatus 50 wherein the rigid planar element 65 is affixed to the building structure 60, with the boxer 210 hitting the speed bag 55 with their hand motion 215 causing the speed bag 55 movement 56, wherein simultaneously the boxer 210 engages in body motion 220 to accommodate the arbitrary speed bag 55 movement 195 to be able to further increase the boxer's 210 multi-tasking agility in coordinated hitting 215 of the speed bag 55 while moving 220 on their feet for the body motion 220 wherein the rebound surface 100 remains intact for the speed bag 55 to rebound appropriately.

Figure 9:
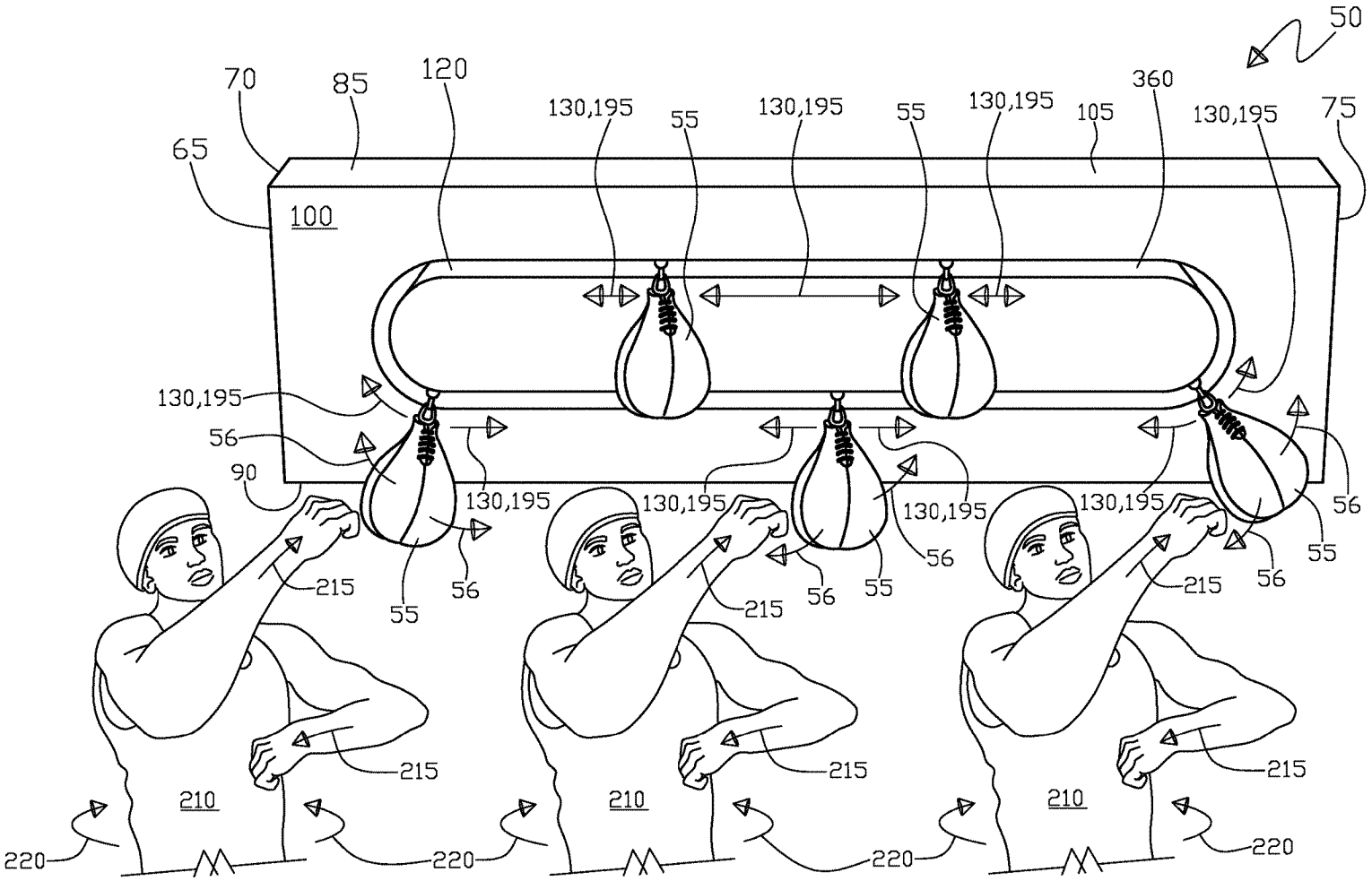
FIG. 9 shows a use drawing of the selectable speed bag support apparatus wherein the rigid planar element could be affixed to the building structure, with a plurality of boxers each hitting one of a plurality of speed bags with their hand motions causing the speed bag movement wherein simultaneously each boxer engages in body motion to accommodate the arbitrary speed bag movement within an elongated aperture forming an endless loop to be able to further increase each boxer's multi-tasking agility in coordinated hitting of the speed bag while moving on their feet for the body motion wherein the rebound surface remains intact for the speed bag to rebound appropriately.

Next, FIG. 9 shows a use drawing of the selectable speed bag support apparatus 50 wherein the rigid planar element 65 could be affixed to the building structure 60, with a plurality of boxers 210 each hitting one of a plurality of speed bags 55 with their hand motions 215 causing the speed bag 55 movement 56 wherein simultaneously each boxer 210 engages in body motion 220 to accommodate the arbitrary speed bag 55 movement 130, 195 within an elongated aperture forming an endless loop 360 to be able to further increase each boxer's 210 multi-tasking agility in coordinated hitting of the speed bag 55 while moving on their feet for the body motion 220 wherein the rebound surface 100 remains intact for the speed bag 55 to rebound appropriately.

Figure 10:
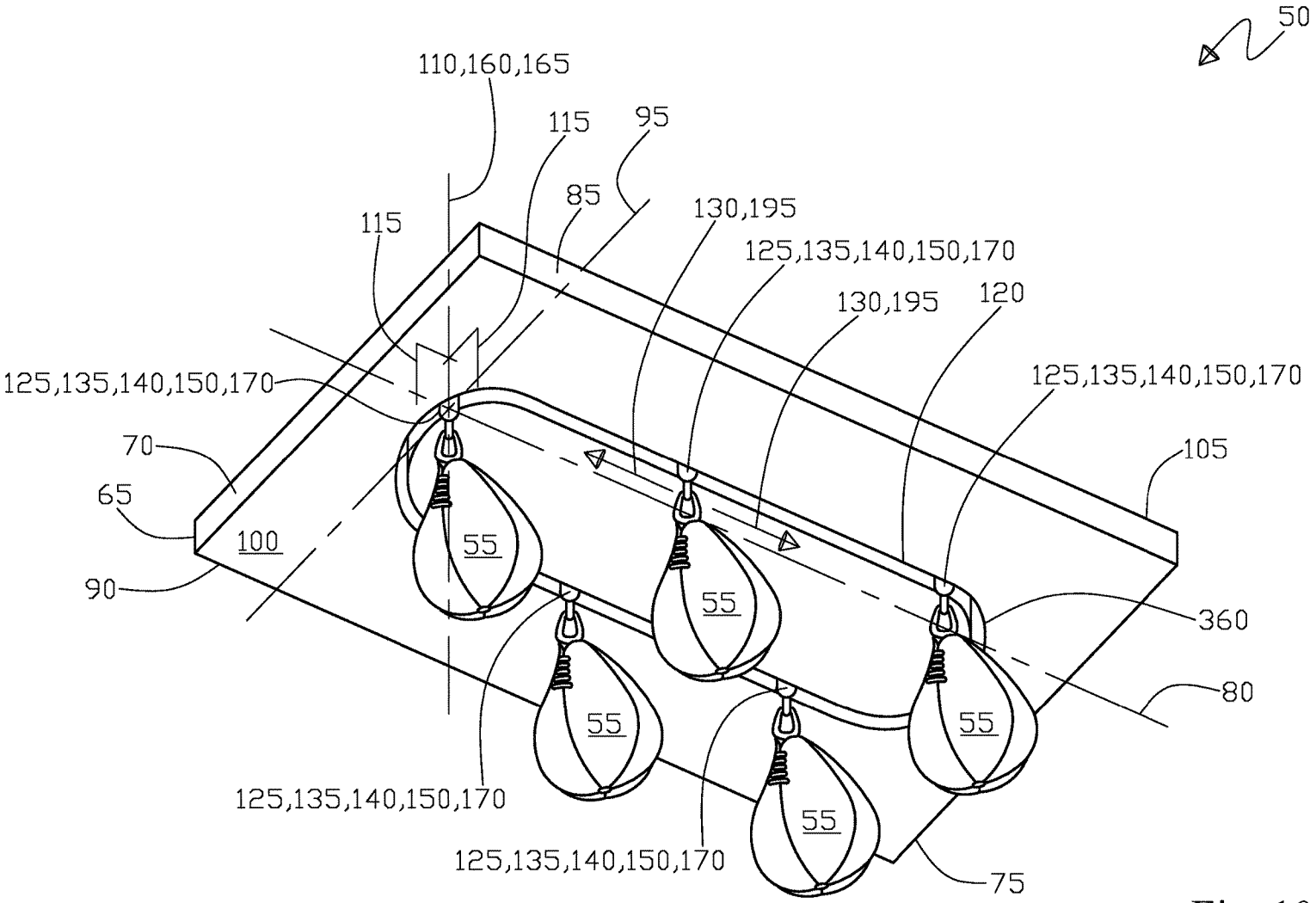
FIG. 10 shows a front perspective elevation view of the selectable speed bag support apparatus that includes the rigid planar element having the elongated aperture forming the endless loop, with first and second end portions along with first and second margins, a longitudinal axis, and a transverse axis with the plurality of speed bags shown.

Continuing, FIG. 10 shows a front perspective elevation view of the selectable speed bag support apparatus 50 that includes the rigid planar element 65 having the elongated aperture forming the endless loop 360, with first 70 and second 75 end portions along with first 85 and second 90 margins, the longitudinal axis 80, and the transverse axis 95 with the plurality of speed bags 55 shown.

Figure 11:
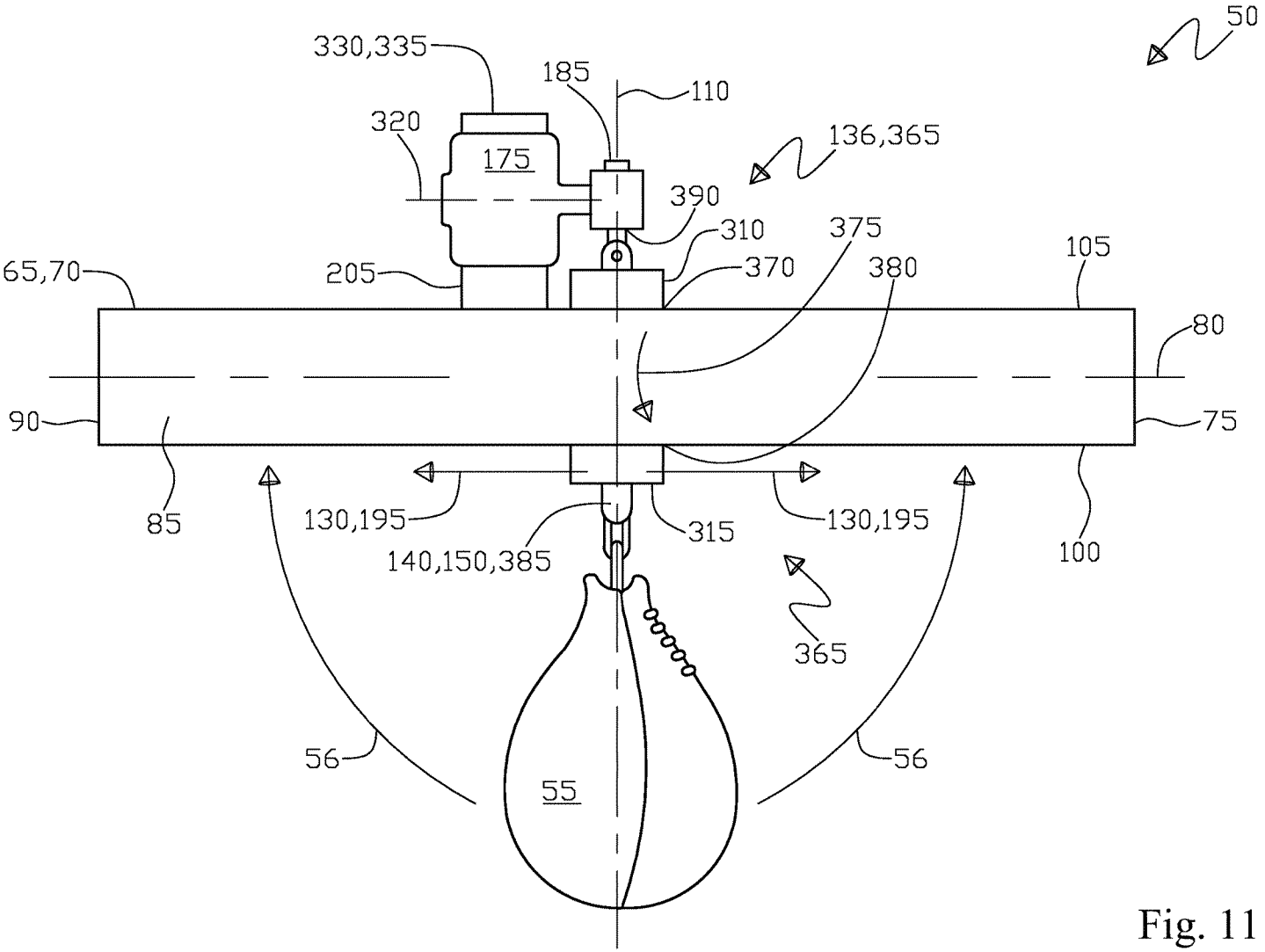
FIG. 11 shows in particular the rigid planar element and transverse axis with a primary magnetic mover magnetically coupled therethrough the rigid planar element to a secondary magnetic follower that is adapted to dynamically attach to the speed bag, also shown is a means for suspending and moving the speed bag therethrough the rigid planar element, wherein the means shown includes the drive motor, the drive belt, the attachment of a drive belt to the primary magnetic mover, all with the means mounted on the work surface.

Further, FIG. 11 shows in particular the rigid planar element 65 and transverse axis 95 with a primary magnetic mover 310 magnetically coupled 375 therethrough the rigid planar element 65 to a secondary magnetic follower 315 that is adapted 385 to dynamically attach to the speed bag 55, also shown is a means 136 for suspending and moving 30, 195 the speed bag 55 therethrough the rigid planar element 65, wherein the means 136 shown includes the drive motor 175, the drive belt 185, the attachment 390 of the drive belt 185 to the primary magnetic mover 310, all with the means 136 mounted on the work surface 105.

Figure 12:
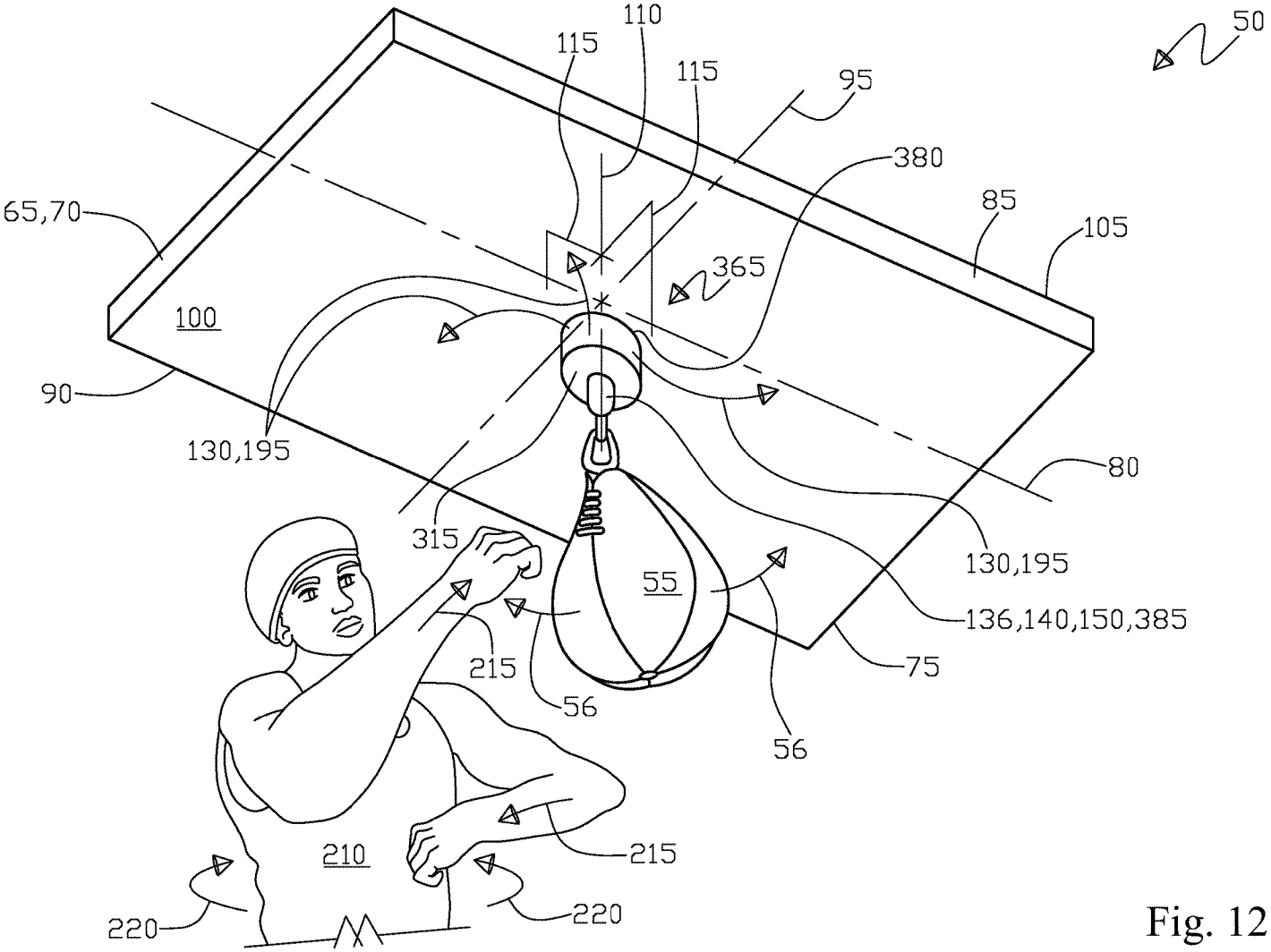
FIG. 12 shows a use drawing of the selectable speed bag support apparatus wherein the rigid planar element could be affixed to the building structure, having the speed bag suspended and moved via the primary magnetic mover magnetically coupled to the secondary magnetic follower, with the boxer hitting the speed bag with their hand motion causing the speed bag movement wherein simultaneously the boxer engages in body motion to accommodate the arbitrary speed bag movement to be able to further increase the boxer's multi-tasking agility in coordinated hitting of the speed bag while moving on their feet for the body motion wherein the rebound surface remains intact for the speed bag to rebound appropriately.

Further, FIG. 12 shows a use drawing of the selectable speed bag support apparatus 50 wherein the rigid planar element 65 could be affixed to the building structure 60, having the speed bag 55 suspended and moved 130, 195 via the primary magnetic mover 310 magnetically coupled 375 to the secondary magnetic follower 315, with the boxer 210 hitting the speed bag 55 their hand motion 215 causing the speed bag 55 movement 56 wherein simultaneously the boxer 210 engages in body motion 220 to accommodate the arbitrary speed bag 55 movement 130, 195 to be able to further increase the boxer's 210 multi-tasking agility in coordinated hitting of the speed bag 55 while moving on their feet for the body motion 220 wherein the rebound surface 100 remains intact for the speed bag 55 to rebound appropriately.

Figure 13:
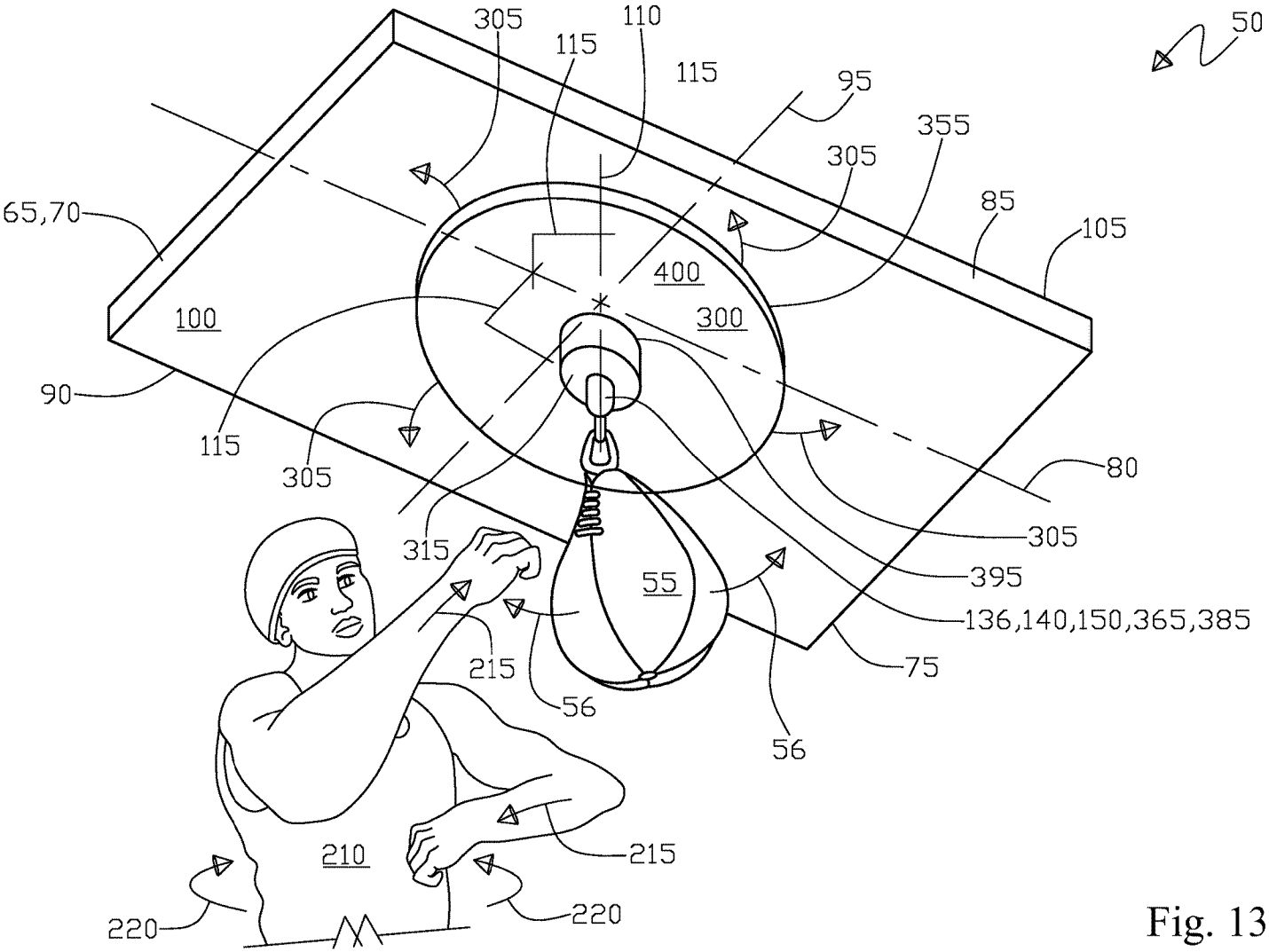
FIG. 13 shows a use drawing of the selectable speed bag support apparatus wherein the rigid planar element could be affixed to the building structure having the speed bag suspended and moved via the primary magnetic mover magnetically coupled to the secondary magnetic follower, with the boxer hitting the speed bag with their hand motion causing the speed bag movement wherein simultaneously the boxer engages in body motion to accommodate the arbitrary speed bag movement to be able to further increase the boxer's multi-tasking agility in coordinated hitting of the speed bag while moving on their feet for the body motion wherein the rebound surface moves in accord with the speed bag, wherein the rebound surface is in the form of a disc that travels with the speed bag movement relative to the rigid planar element to eliminate the speed bag rebound surface movement relative to the dynamic attachment of the speed bag to maximize speed bag rebound energy via the speed bag rebounding in an opposing direction from a static surface of the disc even though the speed bag is moving relative to the rigid planar element.

Moving onward, FIG. 13 shows a use drawing of the selectable speed bag support apparatus 50 wherein the rigid planar element 65 could be affixed to the building structure 60 having the speed bag 55 suspended and moved via the primary magnetic mover 310 magnetically coupled 375 to the secondary magnetic follower 315, with the boxer 210 hitting the speed bag 55 with their hand motion 215 causing the speed bag 55 movement 56 wherein simultaneously the boxer 210 engages in body motion 220 to accommodate the arbitrary speed bag 55 movement 130, 195 to be able to further increase the boxer's 210 multi-tasking agility in coordinated hitting 215 of the speed bag 55 while moving on their feet for the body motion 220. Wherein FIG. 13 also shows the rebound surface 400 that moves 305 in accord with the speed bag 55 wherein the rebound surface 400 is in the form of a disc 300 that travels with the speed bag 55 movement 305 relative to the static rigid planar element 65 to eliminate the speed bag 55 rebound surface 400 movement relative to the dynamic attachment 385 of the speed bag 55 to maximize speed bag 55 rebound energy via the speed bag 55 rebounding in an opposite direction from the static surface 400 of the disc 300 even though the speed bag 55 is moving 305 relative to the static rigid planar element 65.

Figure 14:
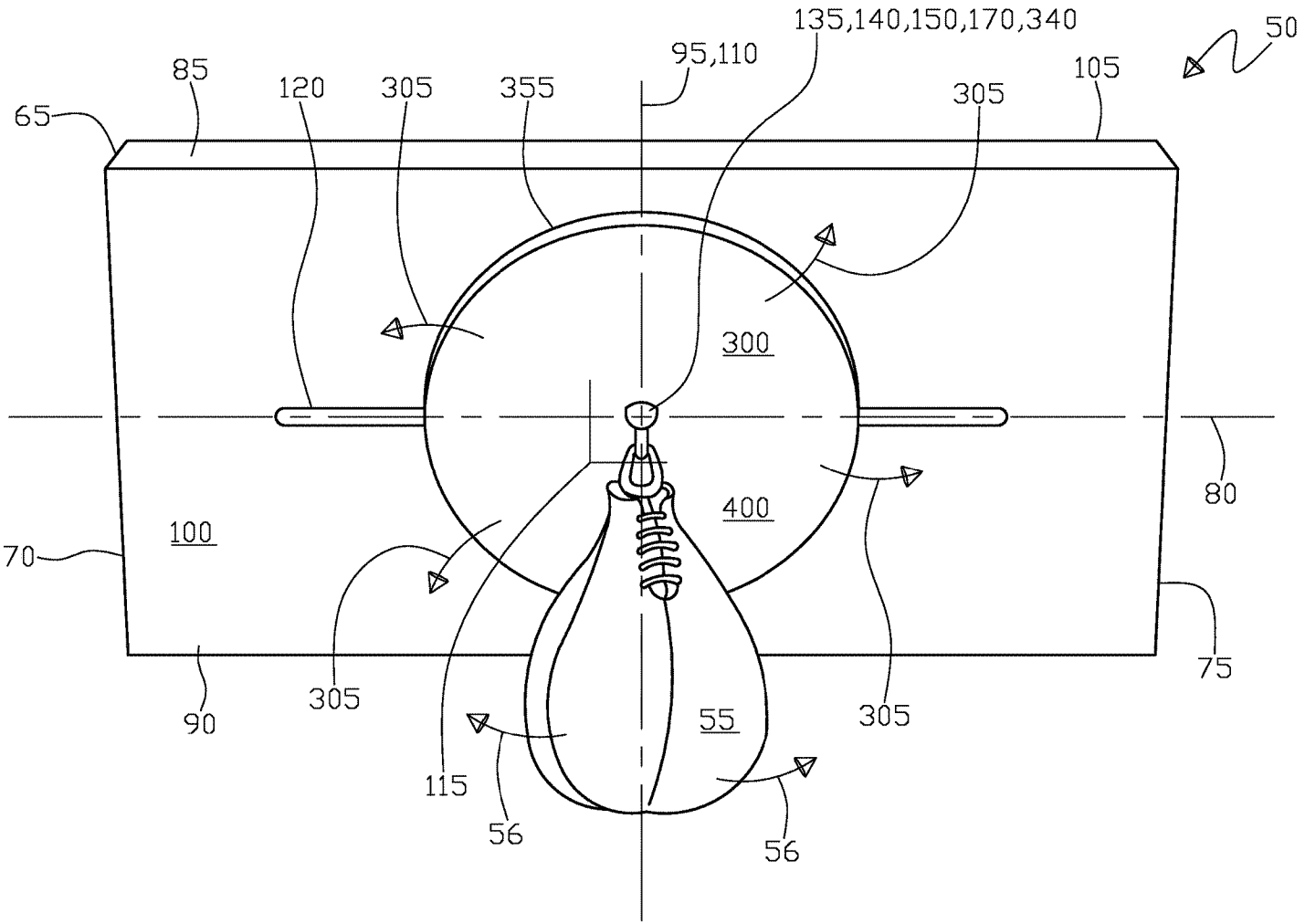
FIG. 14 shows a drawing of the selectable speed bag support apparatus wherein the rigid planar element could be affixed to the building structure having the speed bag suspended and moved via the carriage therethrough the elongated aperture, wherein the rebound surface moves in accord with the speed bag wherein the rebound surface is in the form of a disc that travels with the speed bag movement relative to the rigid planar element to eliminate the speed bag rebound surface movement relative to the dynamic attachment of the speed bag to maximize speed bag rebound energy via the speed bag rebounding in an opposing direction from a static surface of the disc even though the speed bag is moving relative to the rigid planar element.

Yet further, FIG. 14 shows a drawing of the selectable speed bag support apparatus 50 wherein the rigid planar element 65 could be affixed to the building structure 60 having the speed bag 55 suspended and moved via the carriage 140 therethrough the elongated aperture 120, 360 wherein the speed bag 55 movement 56 is shown, wherein the rebound surface 400 moves 305 in accord with the speed bag 55 wherein the rebound surface 400 is in the form of a disc 300 that travels 305 with the speed bag 55 movement 305 relative to the static rigid planar element 65 to eliminate the speed bag 55 rebound surface 400 movement relative to the dynamic attachment 385 of the speed bag 55 to maximize speed bag 55 rebound energy via the speed bag 55 rebounding in an opposite direction from a static surface 400 of the disc 300 even though the speed bag 55 is moving 305 relative to the rigid planar element 65.

Figure 15:
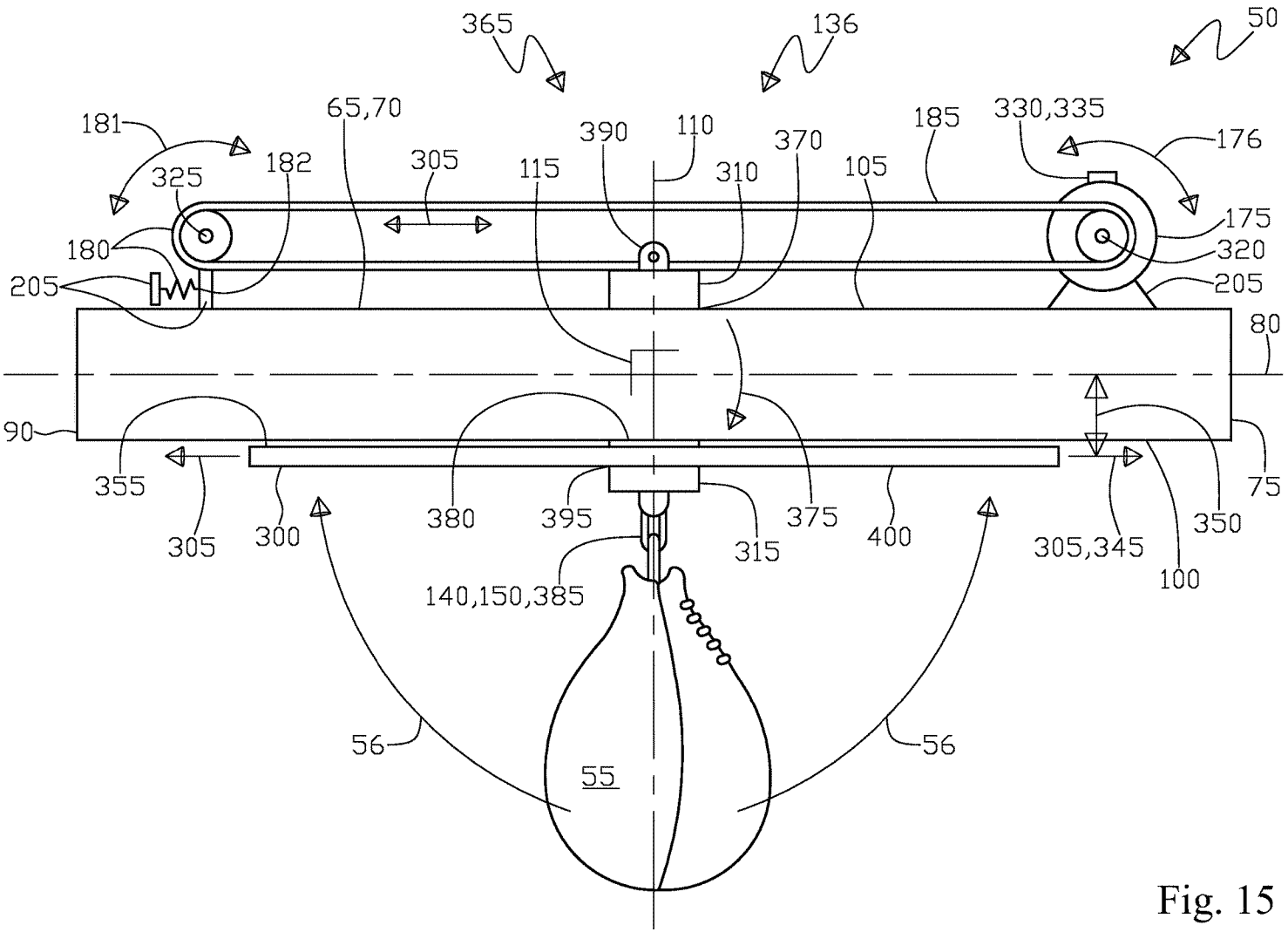
FIG. 15 shows FIG. 11 from a right hand elevation view with the addition of the disc with the means for suspending and moving the speed bag therethrough the rigid planar element having the speed bag suspended and moved via the primary magnetic mover magnetically coupled to the secondary magnetic follower wherein the means includes the drive motor, the tensioner pulley, the drive belt, plus the attachment of the drive belt to the primary magnetic mover, all with the means mounted on the work surface.

Continuing, FIG. 15 shows FIG. 11 from a right hand elevation view with the addition of the disc 300 with the means 136 for suspending and moving the speed bag 55 therethrough the rigid planar element 65 wherein the means 136 includes the drive motor 175, the tensioner pulley 180, the drive belt 185, an attachment 390 of the drive belt 185 to the primary magnetic mover 310 this having the speed bag 55 suspended and moved 305 via the primary magnetic mover 310 magnetically coupled 375 to the secondary magnetic follower 315, all with the means 136 mounted on the work surface 105.

Broadly, in referring to FIGS. 1 through 10 and FIG. 14 for structure and FIGS. 8, 9, and 10 for use, the present invention of the selectable support apparatus 50 for the speed bag 55 is disclosed, with the support apparatus 50 being optionally adjacent or affixed to a building structure 60, as best shown in FIGS. 8, 9, 10, and 14 wherein it is important that the rigid planar element 65 be rigidly affixed to a wall or ceiling for the rebound surface 100 to be sufficient stiff or rigid and be damped such that the rebound surface 100 absorbs very little kinetic energy from the speed bag 55 movement 130, 195, thus resulting in the speed bag 55 desirably having a strong rebound from the rebound surface 100. Also optionally, the support apparatus 50 could also be affixed to a portable structure (not shown) having enough mass and rigidity to enable the rebound surface 100 as described above to have strong rebounds from the speed bag 55.

The selectable support apparatus 50 includes the rigid planar element 65 having the first end portion 70 and the opposing second end portion 75 with the longitudinal axis 80 spanning therebetween, the rigid planar element 65 also includes the first margin 85 and the opposing second margin 90 with the transverse axis 95 spanning therebetween, see FIGS. 1, 4, 7, 8, 9, 10, and 14. Further, the rigid planar element 65 having the rebound surface 100 for the speed bag 55 and the opposing work surface 105 with the centerline axis 110 spanning therebetween, see FIGS. 2, 3, 5, 6, 7, 8, 10, and 14. Wherein the longitudinal axis 80, the transverse axis 95, and the centerline axis 110 are all perpendicularly positioned 115 to one another, see in particular FIGS. 8 and 14.

The rigid planar element 65 also includes the elongated aperture 120, see FIGS. 1 to 8 and 14 or optionally the elongated aperture forming an endless loop 360, see FIGS. 9 and 10, that is disposed therethrough the rigid planar element 65 wherein the elongated aperture 120 or the elongated aperture forming an endless loop 360 is positioned parallel to and along the longitudinal axis 80, see FIGS. 1, 4, 7, 8, and 14. The elongated aperture 120 or the elongated aperture forming an endless loop 360 extends for a portion of the rigid planar element 65 as between the first 70 and second 75 end portions, see FIGS. 1, 2, 4, 5, 7, 8, 9, 10, and 14. Also, the elongated aperture 120 or the elongated aperture forming an endless loop 360 extends from the rebound surface 100 to the work surface 105 along the centerline axis 110, see FIGS. 2, 3, 5, 6, 8, 9, 10, and 14.

In addition, the selectable support apparatus 50 for the speed bag 55 includes the means 135 for suspending 125 and moving 130 the speed bag 55 therethrough and along the elongated aperture 120 or the elongated aperture forming an endless loop 360, see in particular FIGS. 5, 6, 7, 8, 9, 10, and 14.

Optionally, on the selectable support apparatus 50 for the speed bag 55, the means 135 for suspending 125 and moving 130 the speed bag 55 can be constructed of the carriage 140 that is slidably engaged 145 to the elongated aperture 120 or the elongated aperture forming an endless loop 360, the carriage 140 has the primary end portion 150 and the opposing secondary end portion 155 with the long axis 160 spanning therebetween, wherein the long axis 160 is parallel 165 to the centerline axis 110. The primary end portion 150 is adapted 170 to dynamically attach to the speed bag 55, plus further included in the means 135 for suspending 125 and moving 130 the speed bag 55 is the drive motor 175, the tensioner pulley 180, and the drive belt 185 that is suspended between the drive motor 175 and the tensioner pulley 180 with the drive belt 185 attached 190 to the secondary portion 155, see in particular FIGS. 5, 6, 7, and 8.

Note that the slidable engagement 145 is exaggerated in FIGS. 2, 3, 5, and 6, for pictorial clarity, wherein the extension 141 of the carriage 140 has the slidable engagement 145 with the channel 121, as best shown in FIGS. 2, 3, 5, 6, 8, 9, 10, and 14, to give the carriage 140 stability along the long axis 160 in relation to perpendicularity 115 (i.e. minimal deviation from perpendicularity 115 during movement 130, 195) while the carriage is moving therethrough the elongated aperture 120 or the elongated aperture forming an endless loop 360. The two desired results are to make the slidable engagement 145 tight and to minimize the area of the elongated aperture 120 or the elongated aperture forming an endless loop 360 in the rebound surface 100 resulting in the speed bag 55 having a maximum rebound during the combination of movements 56 and 130, 195. Wherein operationally, the drive motor 175 moves 130, 195 the carriage 140 within the elongated aperture 120 the elongated aperture forming an endless loop 360 substantially parallel to the longitudinal axis 80, thus moving the speed bag 55, see in particular FIGS. 8, 9, 10, and 14. Further, optionally for the support apparatus 50 for the speed bag 55, the drive motor 175 and the tensioner pulley 180 can be both mounted on the work surface 105, see in particular FIGS. 5, 6, 7, and 8.

Optionally, for the support apparatus 50 for the speed bag 55 wherein the drive motor 175 further comprises control circuitry 330 to selectively vary a rotational speed 176 of the drive motor to operationally result in selectably variable movement velocity 130, 195, 305 of the speed bag 55, see FIGS. 5, 6, 7, 11, and 15. Also optionally for the support apparatus 50 for the speed bag 55 wherein the drive motor 175 further comprises control circuitry 335 to selectively facilitate a varying sequence of a rotational speed 176 of the drive motor 175 to operationally result in selectably multiple variable movement velocities 130, 195, 305 of the speed bag 55, also see FIGS. 5, 6, 7, 11, and 15.

A further option for the support apparatus 50 for the speed bag 55 wherein the means 135 for suspending and moving the speed bag 55 therethrough and along the elongated aperture 120 or the elongated aperture forming an endless loop 360 further includes a disc 300 affixed 340 to the primary end portion 150 of the carriage 140, the disc 300 having a radial plane 345 that is positioned parallel 350 to the longitudinal axis 80 and the transverse axis 95, further the disc 300 is positioned to have a slidable contact 355 with the rebound surface 100, wherein operationally the disc 300 acts as a dynamic rebound surface 400 for the speed bag 55 as the disc 300 moves in conjunction with the means 135 for suspending and moving the speed bag 55 therethrough and along the elongated aperture 120 or the elongated aperture forming an endless loop 360 with the disc 300 moving in relation to the rigid planar element 65 being static, see FIGS. 5, 6, 7, having the means 135 that would be combined with FIG. 14 with the disc 300.

See FIG. 14, thus the disc 300 gives the speed bag a relatively static rebound surface 400 in relation to the speed bag 55 attachment 170 (as both move 305 together) so that the speed bag 55 rebound force is maximized and in an opposing direction that is in line with the boxers 210 hit 215 as compared to the speed bag 55 moving 130, 195 in relation to the static rebound surface 100 which adds a horizontal force vector (parallel to the longitudinal 80 and transverse 95 axes) altering the speed bag 55 rebound bounce back angle from the moving rebound surface 100 relative to the speed bag 55 attachment 170 (being without the disc 300).

In looking at FIGS. 11, 12, 13, and 15 in particular, an alternative embodiment for the support apparatus 50 for the speed bag 55 is shown, where the support apparatus 50 can be adjacent to the building structure 60, the support apparatus 50 includes a rigid planar element 65 with a first end portion 70 and an opposing second end portion 75 with a longitudinal axis 80 spanning therebetween. The rigid planar element 65 also includes a first margin 85 and an opposing second margin 90 with a transverse axis 95 spanning therebetween, the rigid planar element 65 further including a rebound surface 100 for the speed bag 55 and an opposing work surface 105 with a centerline axis 110 spanning therebetween, wherein the longitudinal axis 80, the transverse axis 95, and the centerline axis 110 are all perpendicularly positioned 115 to one another. Also included in the alternative embodiment of the support apparatus 50 is a means 136 for suspending and moving 130, 195 the speed bag 55 therethrough the rigid planar element 65.

Looking at FIGS. 11, 12, 13, and 15 in particular, as an option for the alternative embodiment of the support apparatus 50 for the speed bag 55 wherein the means 136 for suspending and moving the speed bag 55 is constructed of a magnetic assembly 365 that has a primary magnetic mover 310 slidably 370 in contact with the work surface 105 and a magnetically coupled 375 to an opposing secondary magnetic follower 315 slidably 380 in contact with the rebound surface 100 with the centerline axis 110 spanning therebetween. Wherein the secondary magnetic follower 315 is adapted 385 to dynamically attach to the speed bag 55, further included in the means 136 for suspending and moving 130, 195 the speed bag 55 is a drive motor 175, a tensioner pulley 180, and a drive belt 185 that is suspended between the drive motor 175 and the tensioner pulley 180 with the drive belt 185 attached to the primary magnetic mover 310, wherein operationally the drive motor 175 via the drive belt 185 attachment 390 moves the primary magnetic mover 310 that through the magnetic couple 375 moves the secondary magnetic follower 315, thus moving 130, 195 the speed bag 55 along the rebound surface, as best shown in FIGS. 11 and 15, wherein the drive motor 175 and the tensioner pulley 180 can be both mounted on the work surface 105, again as best shown in FIGS. 11 and 15.

In looking at FIGS. 13 and 15 for the alternative embodiment of the support apparatus 50 for the speed bag 55 wherein the means 136 for suspending and moving 130, 195 the speed bag 55 therethrough the rigid planar element 65 via the magnetic couple 375 can further include a disc 300 affixed 395 to the secondary magnetic follower 315, wherein the disc 300 has a radial plane 345 that is positioned parallel 350 to the longitudinal axis 80 and the transverse axis 95. Further, the disc 300 is positioned to have a slidable contact 355 with the rebound surface 100, wherein operationally the disc 300 acts as a dynamic rebound surface 400 for the speed bag 55 as the disc 300 moves in conjunction with the means 136 for suspending and moving 305 the speed bag 55 therethrough the rigid planar element 65 via the magnetic couple 375 with the disc 300 moving in relation to the rigid planar element 65 being static.

See FIG. 13, thus the disc 300 gives the speed bag a relatively static rebound surface 400 in relation to the speed bag 55 attachment 385 (as both move 305 together) so that the speed bag 55 rebound force is maximized in an opposing direction that is in line with the boxers 210 hit 215 as compared to the speed bag 55 moving 130, 195 in relation to the static rebound surface 100 which adds a horizontal force vector (parallel to the longitudinal 80 and transverse 95 axes) altering the speed bag 55 rebound bounce back angle from the moving rebound surface 100 relative to the speed bag 55 attachment 385 (being without the disc 300).

Method of Use

Referring primarily to FIGS. 8, 9, 12, and 13 for the use views and secondarily to FIGS. 5, 6, 7, 10, 11, 14, and 15, the speed bag 55 can arbitrarily move 130, 195, 305 within the elongated apertures 120, 360, or the magnetic couple 375 either at a constant speed, varying speeds, or have start/stop sequences, wherein this is all to keep the boxer(s) 210 who is continuously hitting 215 the speed bag 55, while at the same time following the speed bag 55 movement 130, 195, 305 to be able to improve coordination and agility of the boxer(s) 210 for their arms and legs.

CONCLUSION

Accordingly, the present invention of a selectable speed bag support apparatus 50 has been described with some degree of particularity directed to the embodiments of the present invention. It should be appreciated, though; that the present invention is defined by the following claims construed in light of the prior art so modifications and changes may be made to the exemplary embodiments of the present invention without departing from the inventive concepts contained therein.

The invention claimed is:

1. A support apparatus for a speed bag, said support apparatus being adjacent to a building structure, said support apparatus comprising:

(a) a rigid planar element including a first end portion and an opposing second end portion with a longitudinal axis spanning therebetween, said rigid planar element also includes a first margin and an opposing second margin with a transverse axis spanning therebetween, said rigid planar element further including a rebound surface for the speed bag and an opposing work surface with a centerline axis spanning therebetween, wherein said longitudinal axis, said transverse axis, and said centerline axis are all perpendicularly positioned to one another;

(b) an elongated aperture disposed therethrough said rigid planar element wherein said elongated aperture is positioned parallel to and along said longitudinal axis, said elongated aperture extends for a portion of said rigid planar element as between said first and second end portions, further said elongated aperture extends from said rebound surface to said work surface along said centerline axis;

(c) a carriage that is slidably engaged to said elongated aperture, said carriage has a primary end portion and an opposing secondary end portion with a long axis spanning therebetween, wherein said long axis is parallel to said centerline axis, said primary end portion is positioned at an interface of said rebound surface and said elongated aperture, said primary end portion is adapted to dynamically attach to the speed bag to operationally facilitate the speed bag to contact said rebound surface and to substantially hide said primary end portion from sight of the boxer to reduce the boxer's visual ability to anticipate the speed bag movement within said elongated aperture; and (d) a means for moving the speed bag therethrough and along said elongated aperture via said carriage.

2. A support apparatus for a speed bag according to claim 1 wherein said means for moving the speed bag is constructed of a drive motor, a tensioner pulley, and a drive belt that is suspended between said drive motor and said tensioner pulley with said drive belt attached to said secondary portion, wherein operationally said drive motor via said drive belt moves said carriage within said elongated aperture parallel to said longitudinal axis, thus moving the speed bag.

3. A support apparatus for a speed bag according to claim 2 wherein said drive motor and said tensioner pulley are both mounted on said work surface.

4. A support apparatus for a speed bag according to claim 2 wherein said drive motor further comprises control circuitry to selectively vary a rotational speed of said drive motor to operationally result in selectably variable movement velocity of the speed bag.

5. A support apparatus for a speed bag according to claim 4 wherein said drive motor further comprises control circuitry to selectively facilitate a varying sequence of a rotational speed of said drive motor to operationally result in selectably multiple variable movement velocity of the speed bag.

6. A support apparatus for a speed bag according to claim 1 wherein said means for moving the speed bag therethrough and along said elongated aperture further includes a disc affixed to said primary end portion of said carriage, said disc having a radial plane that is positioned parallel to said longitudinal axis and said transverse axis, further said disc is positioned to have a slidable contact with said relatively static rebound surface to utilize the inherent rebound stiffness from said rebound surface to transfer to said disc in becoming a dynamic rebound surface, wherein operationally said disc acts as the dynamic rebound surface for the speed bag as said disc moves in conjunction with said means for moving the speed bag therethrough and along said elongated aperture with said disc moving in relation to said rigid planar element being static.

7. A support apparatus for a speed bag, said support apparatus being adjacent to a building structure, said support apparatus comprising:

(a) a rigid planar element including a first end portion and an opposing second end portion with a longitudinal axis spanning therebetween, said rigid planar element also includes a first margin and an opposing second margin with a transverse axis spanning therebetween, said rigid planar element further including a rebound surface for the speed bag and an opposing work surface with a centerline axis spanning therebetween, wherein said longitudinal axis, said transverse axis, and said centerline axis are all perpendicularly positioned to one another;

(b) an elongated aperture forming an endless loop disposed therethrough said rigid planar element wherein said elongated aperture forming an endless loop is positioned substantially parallel to and along said longitudinal axis, said elongated aperture forming an endless loop partially extends for a portion of said rigid planar element as between said first and second end portions, further said elongated aperture forming an endless loop extends from said rebound surface to said work surface along said centerline axis;

(c) a carriage that is slidably engaged to said elongated aperture forming an endless loop, said carriage has a primary end portion and an opposing secondary end portion with a long axis spanning therebetween, wherein said long axis is parallel to said centerline axis, said primary end portion is positioned at an interface of said rebound surface and said elongated aperture forming an endless loop, said primary end portion is adapted to dynamically attach to the speed bag to operationally facilitate the speed bag to contact said rebound surface and to substantially hide said primary end portion from sight of the boxer to reduce the boxer's visual ability to anticipate the speed bag movement within said elongated aperture forming an endless loop; and (d) a means for moving the speed bag therethrough and along said elongated aperture forming an endless loop via said carriage.

8. A support apparatus for a speed bag according to claim 7 wherein said means for moving the speed bag is constructed of a drive motor, a tensioner pulley, and a drive belt that is suspended between said drive motor and said tensioner pulley with said drive belt attached to said secondary portion, wherein operationally said drive motor via said drive belt moves said carriage within said aperture forming an endless loop being substantially parallel to said longitudinal axis, thus moving the speed bag along said aperture forming an endless loop.

9. A support apparatus for a speed bag according to claim 8 wherein said drive motor and said tensioner pulley are both mounted on said work surface.

10. A support apparatus for a speed bag according to claim 8 wherein said drive motor further comprises control circuitry to selectively vary a rotational speed of said drive motor to operationally result in selectably variable movement velocity of the speed bag.

11. A support apparatus for a speed bag according to claim 10 wherein said drive motor further comprises control circuitry to selectively facilitate a varying sequence of a rotational speed of said drive motor to operationally result in selectably multiple variable movement velocity of the speed bag.

12. A support apparatus for a speed bag according to claim 7 wherein said means for moving the speed bag therethrough and along said elongated aperture forming an endless loop further includes a disc affixed to said primary end portion of said carriage, said disc having a radial plane that is positioned parallel to said longitudinal axis and said transverse axis, further said disc is positioned to have a slidable contact with said relatively static rebound surface to utilize the inherent rebound stiffness from said rebound surface to transfer to said disc in becoming a dynamic rebound surface, wherein operationally said disc acts as the dynamic rebound surface for the speed bag as said disc moves in conjunction with said means for moving the speed bag therethrough and along said elongated aperture forming an endless loop with said disc moving in relation to said rigid planar element being static.

13. A support apparatus for a speed bag, said support apparatus being adjacent to a building structure, said support apparatus comprising:

(a) a rigid planar element including a first end portion and an opposing second end portion with a longitudinal axis spanning therebetween, said rigid planar element also includes a first margin and an opposing second margin with a transverse axis spanning therebetween, said rigid planar element further including a rebound surface for the speed bag and an opposing work surface with a centerline axis spanning therebetween, wherein said longitudinal axis, said transverse axis, and said centerline axis are all perpendicularly positioned to one another;

(b) a magnetic assembly that has a primary magnetic mover slidably in contact with said work surface and a magnetically coupled opposing secondary magnetic follower slidably in contact with said rebound surface with said centerline axis spanning therebetween, wherein said secondary magnetic follower is adapted to dynamically attach to the speed bag to operationally facilitate the speed bag to contact said rebound surface from said secondary magnetic follower speed bag dynamic attachment being positioned adjacent to said rebound surface; and (c) a means for moving the speed bag along said rebound surface via said magnetic assembly.

14. A support apparatus for a speed bag according to claim 13 wherein said means for moving the speed bag is constructed of a drive motor, a tensioner pulley, and a drive belt that is suspended between said drive motor and said tensioner pulley with said drive belt attached to said primary magnetic mover, wherein operationally said drive motor via said drive belt moves said primary magnetic mover that through said magnetic couple moves said secondary magnetic follower, thus moving the speed bag along said rebound surface.

15. A support apparatus for a speed bag according to claim 14 wherein said drive motor and said tensioner pulley are both mounted on said work surface.

16. A support apparatus for a speed bag according to claim 14 wherein said drive motor further comprises control circuitry to selectively vary a rotational speed of said drive motor to operationally result in selectably variable movement velocity of the speed bag.

17. A support apparatus for a speed bag according to claim 16 wherein said drive motor further comprises control circuitry to selectively facilitate a varying sequence of a rotational speed of said drive motor to operationally result in selectably multiple variable movement velocity of the speed bag.

18. A support apparatus for a speed bag according to claim 13 wherein said means for moving the speed bag therethrough said rigid planar element further includes a disc affixed to said secondary magnetic follower, wherein said disc has a radial plane that is positioned parallel to said longitudinal axis and said transverse axis, further said disc is positioned to have a slidable contact with said relatively static rebound surface to utilize the inherent rebound stiffness from said rebound surface to transfer to said disc in becoming a dynamic rebound surface, wherein operationally said disc acts as the dynamic rebound surface for the speed bag as said disc moves in conjunction with said means for moving the speed bag therethrough said rigid planar element with said disc moving in relation to said rigid planar element being static.

* * * * *